US007566263B2

(12) United States Patent
Snyder

(10) Patent No.: US 7,566,263 B2
(45) Date of Patent: Jul. 28, 2009

(54) REGISTER GRILLE AND CONNECTOR FRAME WITH RELEASABLE CONNECTION

(75) Inventor: Darryl L. Snyder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 607 days.

(21) Appl. No.: 11/062,183

(22) Filed: Feb. 18, 2005

(65) Prior Publication Data

US 2005/0204664 A1 Sep. 22, 2005

Related U.S. Application Data

(60) Provisional application No. 60/545,668, filed on Feb. 18, 2004, provisional application No. 60/562,779, filed on Apr. 15, 2004.

(51) Int. Cl.
*F24F 13/06* (2006.01)
*F24F 13/08* (2006.01)

(52) U.S. Cl. ..... 454/332; 454/284; 454/309; 454/330; 454/331

(58) Field of Classification Search ..... 454/276, 454/284, 289, 290, 309, 330, 331, 332; 49/51
See application file for complete search history.

(56) References Cited

U.S. PATENT DOCUMENTS 1,336,210 A * 4/1920 Druliner ..... 454/332
2,722,170 A * 11/1955 Broberg ..... 454/332
3,190,209 A * 6/1965 Goetz ..... 454/288
3,217,626 A * 11/1965 Sweeney ..... 454/299
3,236,171 A * 2/1966 Vaskov et al. ..... 49/51
3,366,031 A * 1/1968 Hedrick et al. ..... 454/332
4,334,899 A * 6/1982 McConnell ..... 55/321
5,143,868 A * 9/1992 Caveney et al. ..... 439/535
5,472,380 A * 12/1995 Sarazen et al. ..... 454/290
5,716,270 A * 2/1998 Chambers ..... 454/332
6,192,640 B1 2/2001 Snyder
6,309,297 B1 * 10/2001 Berger ..... 454/290
6,601,356 B2 8/2003 Snyder
6,749,499 B1 6/2004 Snyder
2003/0022616 A1 * 1/2003 Stiehl ..... 454/162

FOREIGN PATENT DOCUMENTS

JP 63259346 A * 10/1988

* cited by examiner

*Primary Examiner*—Steven B McAllister
*Assistant Examiner*—Patrick F. O'Reilly, III
(74) *Attorney, Agent, or Firm*—Zollinger & Burleson Ltd.

(57) ABSTRACT

The invention provides the combination of a grille and a connector frame for a duct outlet in a HVAC system. At least one lock element extends from one of the connector frame and the grille and releaseably engages the other of the connector frame and grille in a releasable connection to hold the grille to the connector frame. The lock element may be manipulated from the exterior of the grille to release the grille from the connector frame without the use of tools.

14 Claims, 30 Drawing Sheets

FIG-3
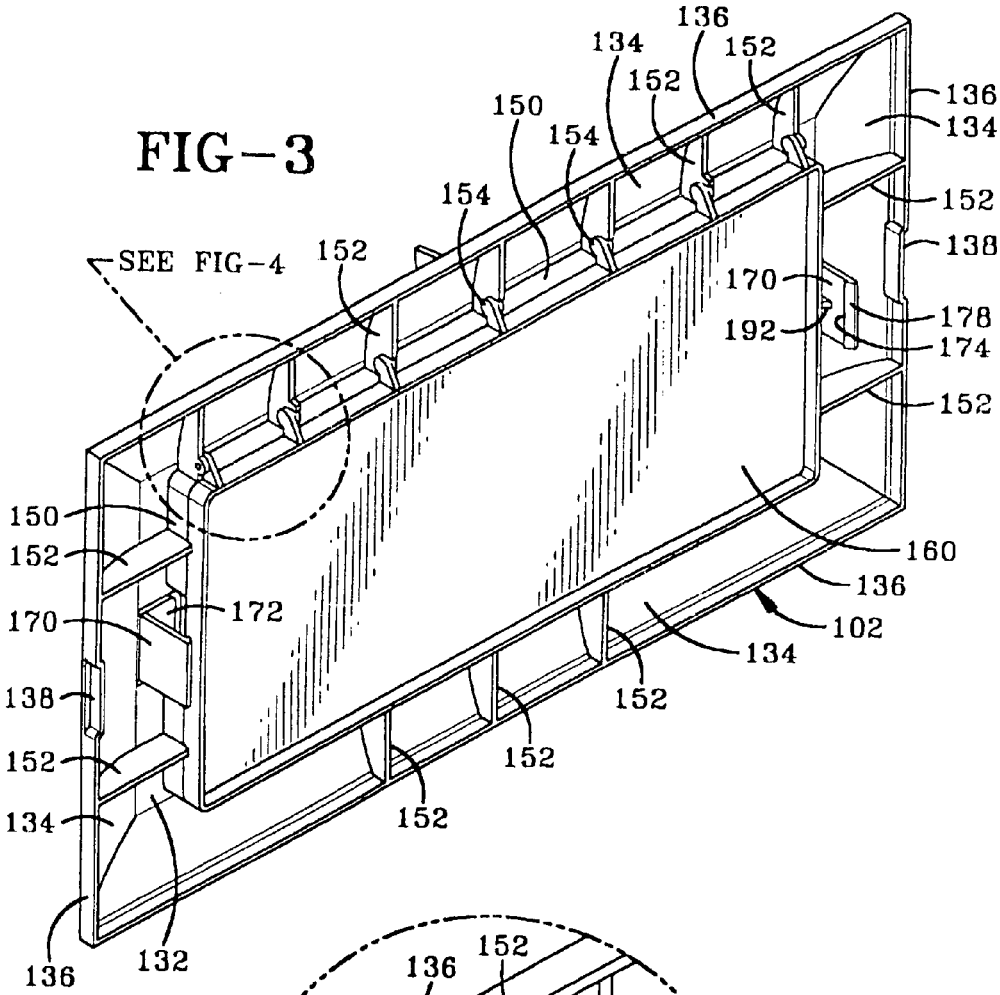
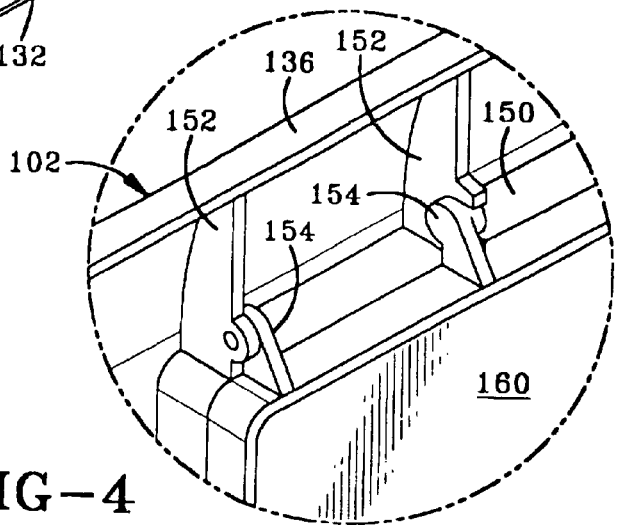
FIG-4

REGISTER GRILLE AND CONNECTOR FRAME WITH RELEASABLE CONNECTION

CROSS REFERENCE TO RELATED APPLICATIONS

This application claims priority from U.S. Provisional Patent Application No. 60/545,668 filed Feb. 18, 2004, and U.S. Provisional Patent Application No. 60/562,779 filed Apr. 15, 2004; the disclosures of which are incorporated herein by reference.

BACKGROUND OF THE INVENTION

1. Technical Field

The present invention generally relates to heating, ventilation, and air conditioning (HVAC) equipment and, more particularly, to the grilles and connector frames that are positioned at the outlet of a duct. Specifically, the present invention relates to a grille that is connected to a connector frame with a releasable connection that may be made and unmade without the use of tools.

2. Background Information

The rooms of building structures having forced air HVAC systems usually have one or more duct endings where the air is delivered into the room. A grille is typically positioned at each duct ending so that the air exiting the duct is dispersed as it enters the room. The grilles must be securely mounted at the duct endings to prevent them from rattling or falling off the wall. The grilles are preferably sealed with respect to the wall to prevent air leakage that will eventually discolor the wall around the grille. Air leakage also results in inefficient air delivery and circulation.

Products that improve the process of mounting a grille are disclosed in U.S. Pat. Nos. 6,192,640 and 6,601,356 which are assigned to the assignee of the present application. These patents disclose connector frames that provide a foundation for mounting a duct end and a grille at location in a wall. Known connector frames provide opposed locations that receive the threaded fasteners that are used to secure a grille to the connector frame. The threaded fasteners allow the grilles to be removed and replaced as needed. One problem with the use of threaded fasteners is that they are exposed at the front of the grille and thus may detract from the aesthetic appearance of the grille. Another problem with the use of threaded fasteners is that they can strip the opposed locations of the connector frame and prevent the grille from being securely attached to the connector frame. A further problem with these designs is that the threaded fasteners can be misplaced and a tool is needed to connect the grille to the connector frame. The art thus desires a grille configured to be re-attachably mounted to a connector frame without the use of threaded connectors that extend through the front surface of the grille.

BRIEF SUMMARY OF THE INVENTION

The present invention provides a grille that may be releasably connected to a connector frame so that the grille may be removed from the connector frame without the use of tools.

In one configuration, the invention provides an configuration having a lock element extending from one of the connector frame and the grille and releaseably engaging the other of the connector frame and grille in a secure manner to hold the grille to the connector frame; the lock element having a disengaged position wherein the grille is removable from the connector frame.

In another configuration, the invention provides a configuration wherein the grille is fabricated from a plastic material and the connectors may be manipulated from the front of the grille.

In a another configuration, the invention provides a lock element having a lock foot and a lock finger that are connected together at a joint; the joint is connected to the body of the grille in a manner that allows the lock finger to move between locked and unlocked positions with respect to the body of the grille. In the locked position, the lock finger securely engages the connector frame to hold the grille to the connector frame.

In a different configuration, the invention provides an configuration having a grille with a vent that allows the grille to be selectively opened and closed.

In another configuration, the invention provides a lock element that displaces a portion of the connector frame when the lock element is moved from the locked position to the unlocked position.

In another configuration, the invention provides a grille and connector frame combination that allows existing grilles to be connected to the connector frame with threaded fasteners while also allowing the grilles of the invention to be releasably connected without threaded fasteners.

These different configurations may be used alone or in combination to achieve desirable results in this art.

In one configuration, the invention provides the combination of a grille and a connector frame for mounting the grille to a mounting surface. The combination has at least one lock element that extends from one of the connector frame and the grille and releasably engages the other of the connector frame and grille in a snap fit connection to hold the grille to the connector frame; the snap fit connector having a disengaged position wherein the grille is removable from the connector frame.

In another configuration, the invention provides a grille for use with a connector frame wherein the grille includes a pair of lock elements that are used to releasably lock the grille to a connector frame. The lock elements may be accessible from the front surface of the grille.

BRIEF DESCRIPTION OF THE SEVERAL VIEWS OF THE DRAWINGS

FIG. 3 is a perspective view of the rear of the grille with the vent in the closed position.

FIG. 4 is an enlarged view of the encircled portion of FIG. 3.

Similar numbers refer to similar parts throughout the specification.

DETAILED DESCRIPTION OF THE INVENTION

Figure 1:
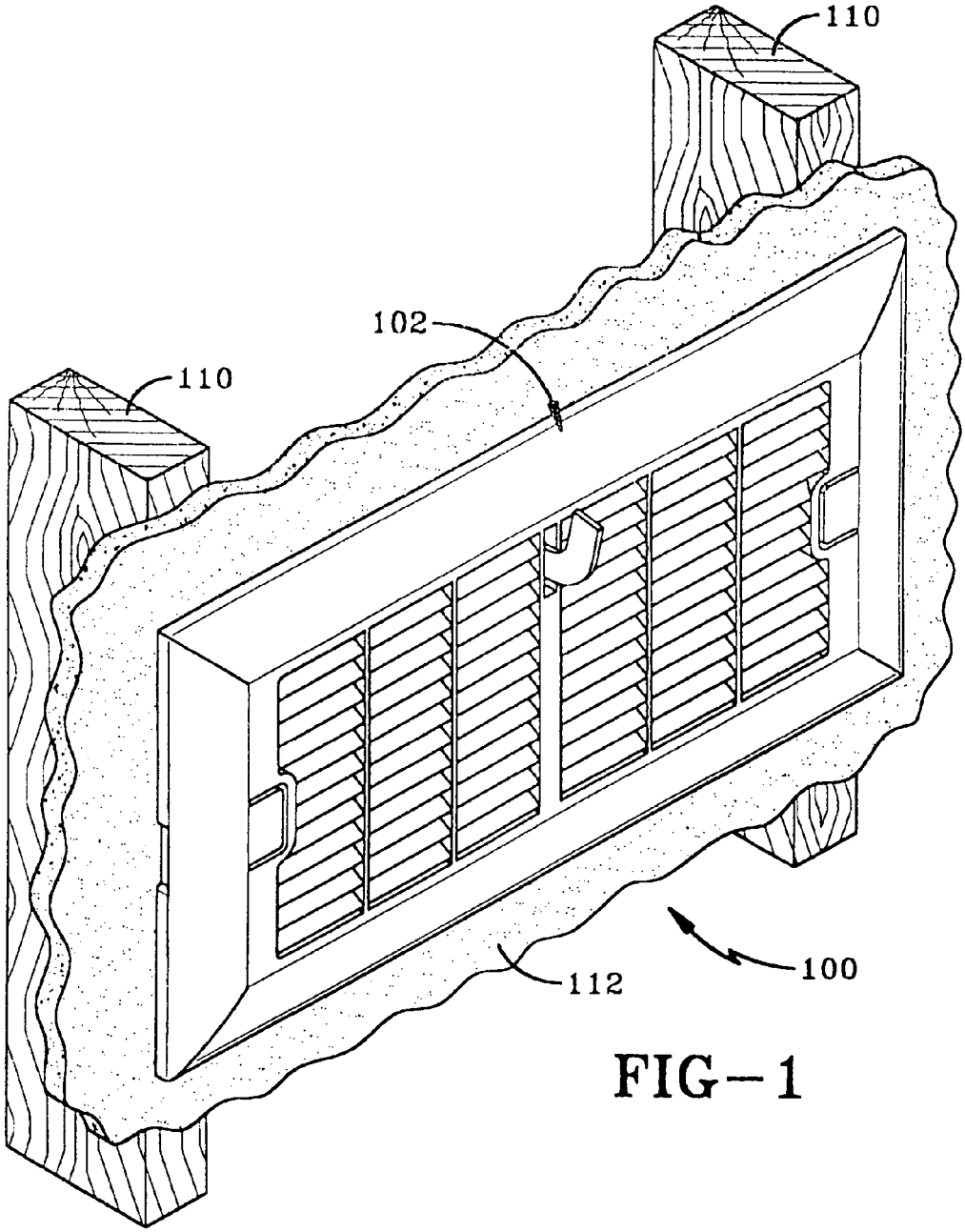
FIG. 1 is a perspective view of an exemplary grille arid connector frame combination of the present invention shown installed in a vertical wall surface.

The combination of the invention is indicated generally by the numeral 100 in the accompanying drawings. Combination 100 generally includes a grille 102 and a connector frame 104 that are releaseably connected together with at least one lock element 106.

As described in the two earlier patents cited above, connector frames similar to connector frame 104 are used grilles at the outlet of a duct 108. U.S. Pat. Nos. 6,192,640 and 6,601,356 are incorporated herein by reference for the purposes of describing how connector frames are used and installed between structures such as the wall studs 110 and the wall covering 112 shown in the drawings. Connector frame 104 may be connected to supports 110 (or other supports) by connectors 114. Frame 104 defines a duct opening for duct 108 while providing a mounting structure for grille 102.

Figure 2:
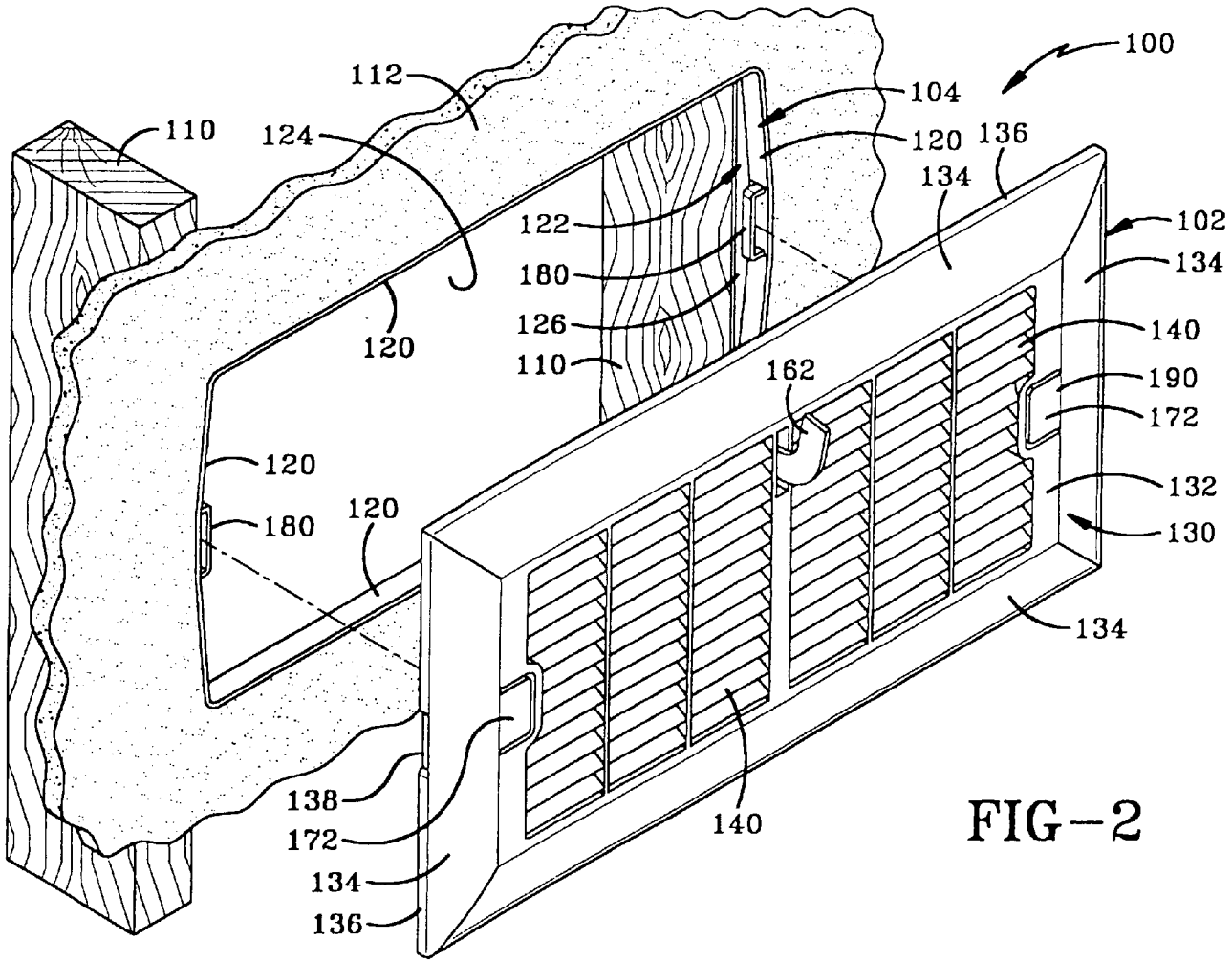
FIG. 2 is an exploded view of the combination of FIG. 1.
Figure 5:
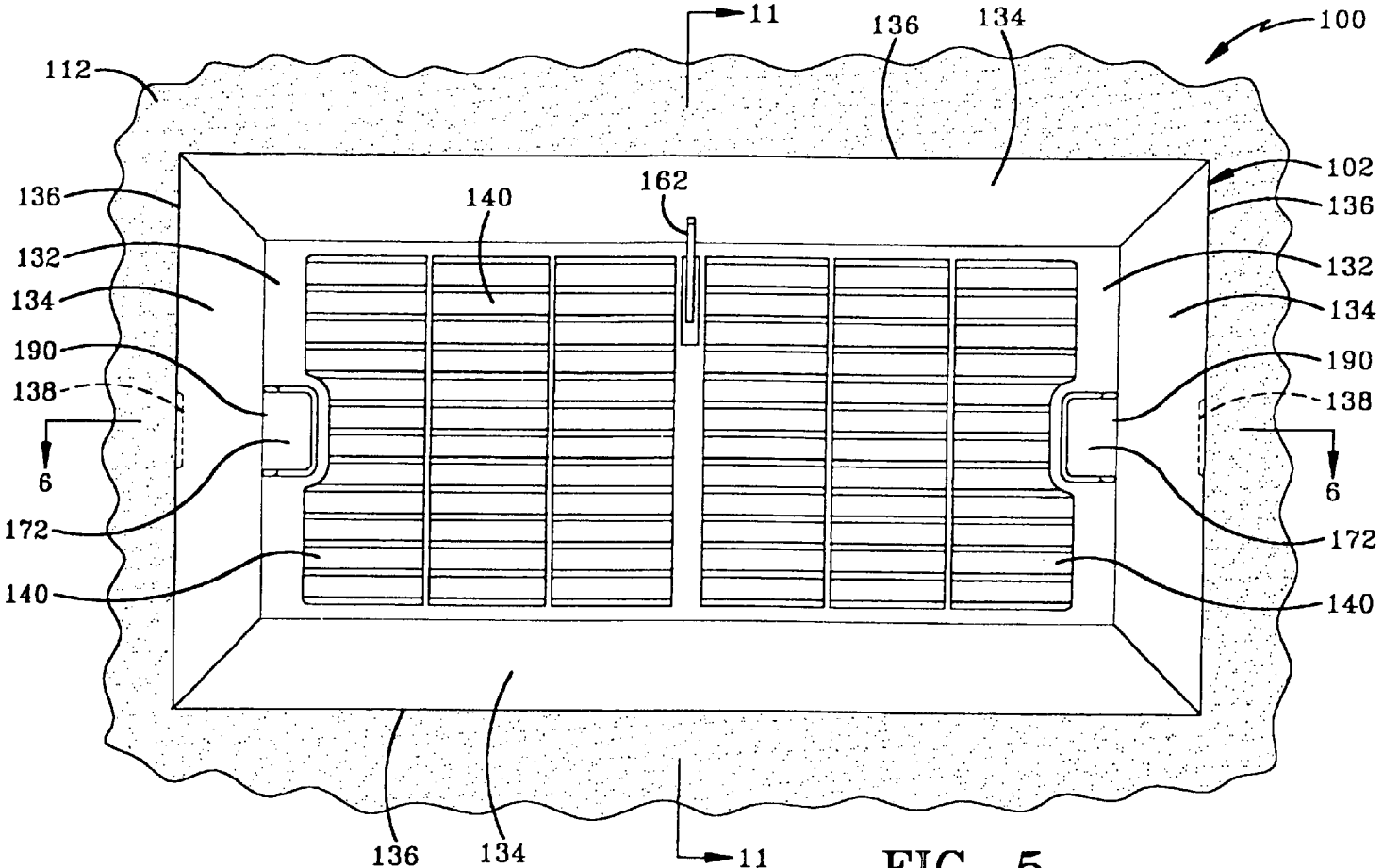
FIG. 5 is a front elevation view of FIG. 1.
Figure 6:
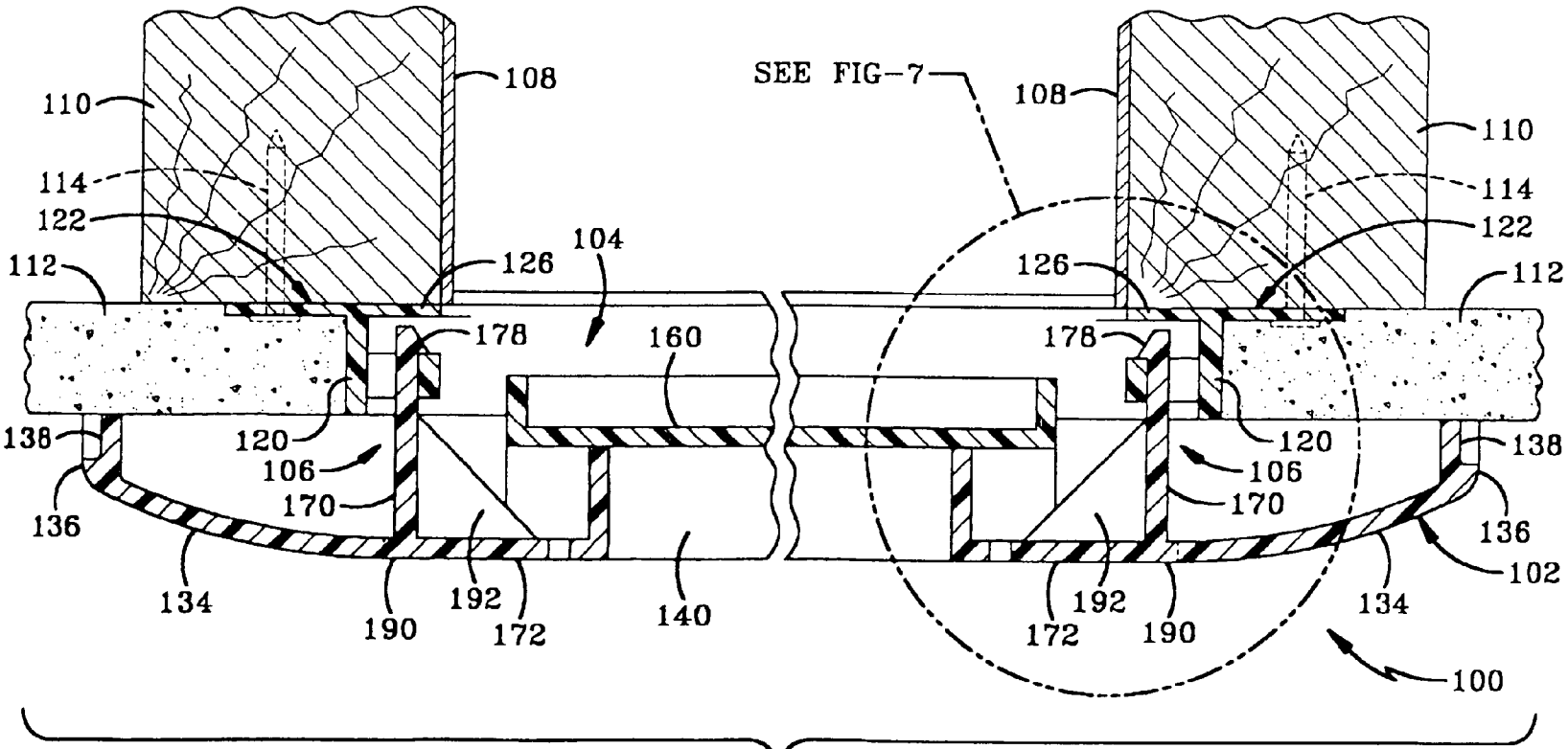
FIG. 6 is a section view taken along line 6-6 of FIG. 5.

In the exemplary configuration, connector frame 104 has a rectangular shape with a longer length dimension and a shorter width dimension. Connector frame 104 may also be provided for use with square, hexagonal, round, and triangular vents 102. Connector frame 104 includes at least a first flange 120 that projects outwardly from a body 122. Flange 120 and body 122 are perpendicular with respect to each other in the exemplary configuration of the invention. As shown in FIG. 2, body 122 and flange 120 define the opening 124 that defines the outlet for duct 108. Flange 120 may be continuous as shown in the drawings or may include a plurality of spaced sections that are disposed around opening 124. Flange 120 extends from body 122 a distance substantially equal to the thickness of wall covering 112 although flange 120 may be shorter or longer as needed because there is room for the adjustment as shown in FIG. 6. Frame 104 may be used with different wall coverings 112 of different thicknesses as described below. Body 122 extends outwardly past flange 120 to provide areas where connectors 114 pass through body 122 and into support structure 110 as shown in FIG. 6.

Figure 11:
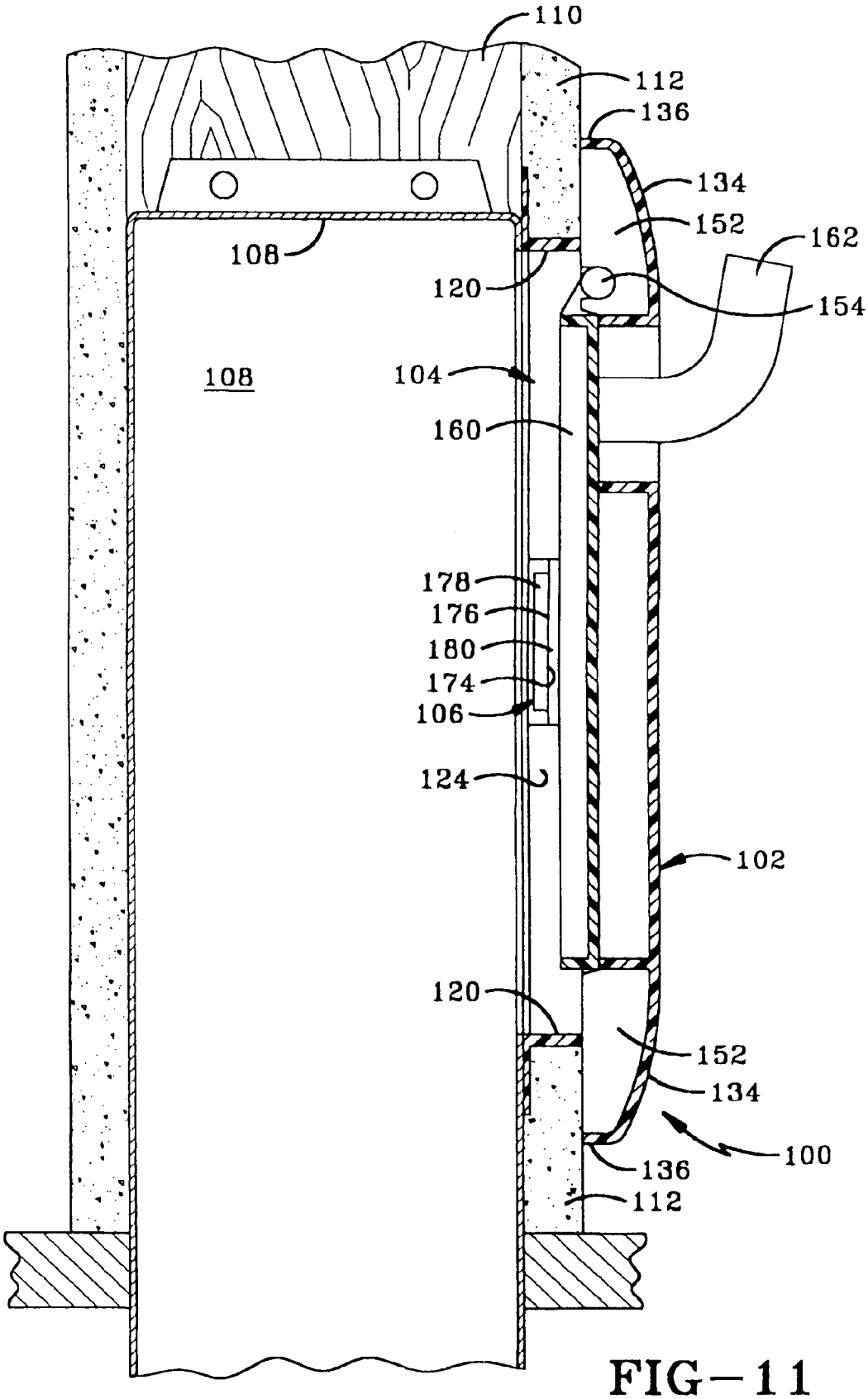
FIG. 11 is a section view taken along line 11-11 of FIG. 5.

As shown in FIG. 2, a portion of body 122 extends inwardly from flange 120 to form an inner ledge 126. Inner ledges 0.126 may be defined by forming flange 120 with outwardly disposed bends as shown in FIG. 2. Body 122 also includes portions that project outwardly from flange 120 to form outer ledges as shown in FIGS. 6 and 11. These outer ledges are disposed between a portion of wall covering 112 and stud 110. Connector frame 104 may be integrally fabricated from a single mold and may be fabricated from a moldable plastic.

Grille 102 generally includes a body 130 having a front wall 132, a perimeter edge wall 134 that extends about the perimeter of front wall 132 to provide a smooth transition between the front surface of front wall 132 and a side wall 136. Side wall 136 defines a pair of opposed finger access notches 138 that allow the user to obtain grip on grille 102 when the user is removing grille 102 from connector frame 104. Although notches 138 may extend entirely through side wall 136, notches 138 that do not extend entirely through side wall 136 will not leak air from the sides of grille 102 that would eventually discolor the front surface of wall covering 112.

Front wall 132 defines a plurality of louvers 140 that may be formed in a variety of configurations and patterns. Louvers 140 may be adjustable in some configurations so that the air flowing through opening 124 may be directed upwardly, downwardly, left, or right. An inner perimeter wall 150 extends rearwardly from the rear surface of front wall 132 as shown in FIGS. 3 and 4. Inner perimeter wall 150 extends around the common perimeter of the plurality of openings defined by front wall 132. A plurality of support ribs 152 are used to stiffen grille 102 by extending between side wall 136 and inner perimeter wall 150.

Figure 12:
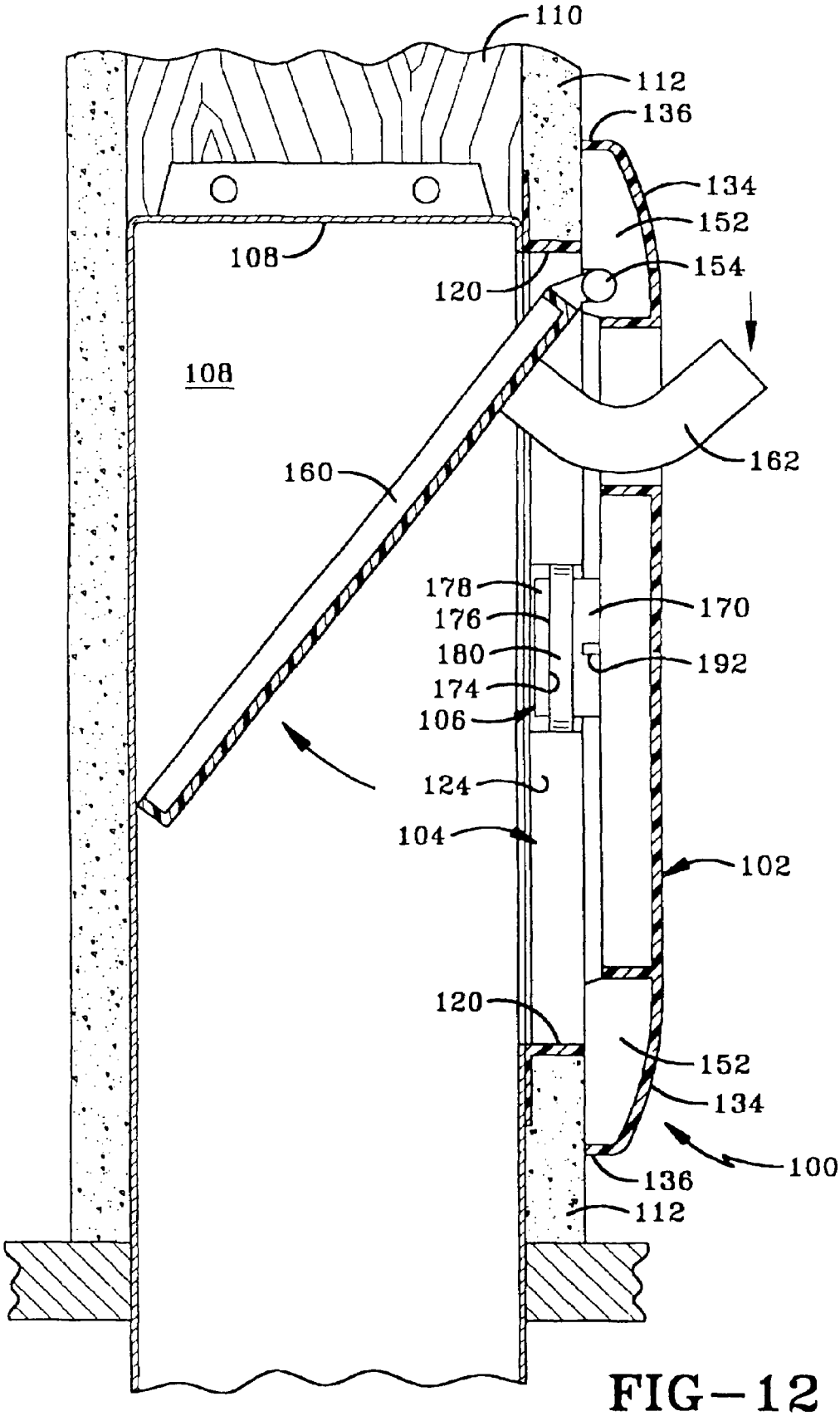
FIG. 12 is a section view similar to FIG. 11 showing the vent in the open position.
Figure 13:
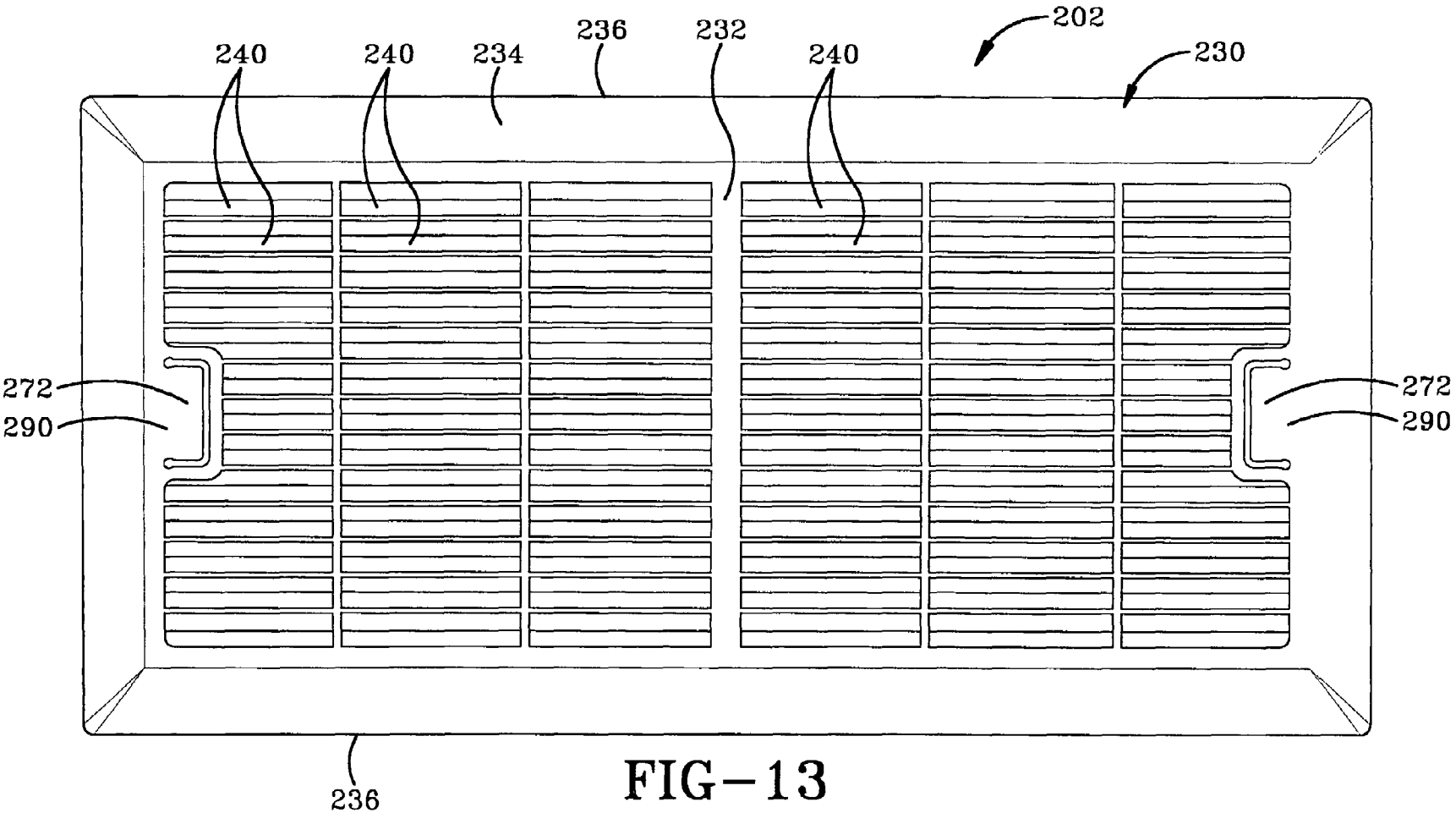
FIG. 13 is a front elevation view of an alternative configuration of the grille of the invention.

In an alternative configuration of the invention, a vent 160 is pivotably carried by grille 102 between the closed position of FIGS. 3 and 11 and the open position of FIG. 12. A handle 162 is carried by vent 160 and extends through front wall 132 of grille 102. Handle 162 remains exposed and accessible from the front of grille 102 in both the closed and open positions of vent 160 as shown in FIGS. 11 and 12. Vent 160 is pivotably carried by a hinge that pivotably supports vent 160 to grille 102. In the exemplary configuration, the hinge includes a plurality of hinge bars 154 that are seating in corresponding notches defined by support ribs 152 as shown on the right side of FIG. 4. Bars 154 may also be connected to support ribs 152 with snap pins as depicted on the left side of FIG. 4. This hinge configuration provides a hinge that is integrally fabricated with vent 160 and grille 102 so that a third hinge piece does not need to be manufactured and assembled. The hinge also fits with the profile of grille 102 so that it does not interfere with connector frame 104.

Figure 7:
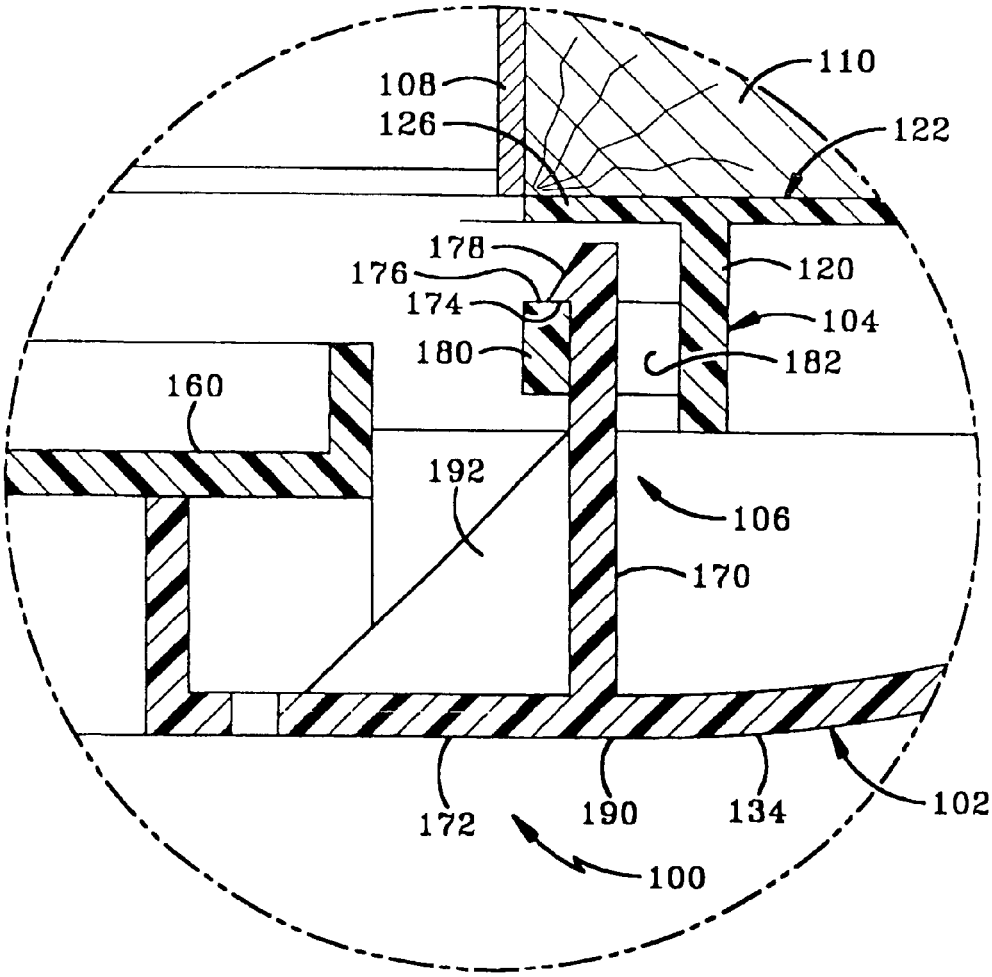
FIG. 7 is an enlarged view of the encircled portion of FIG. 6.
Figure 8:
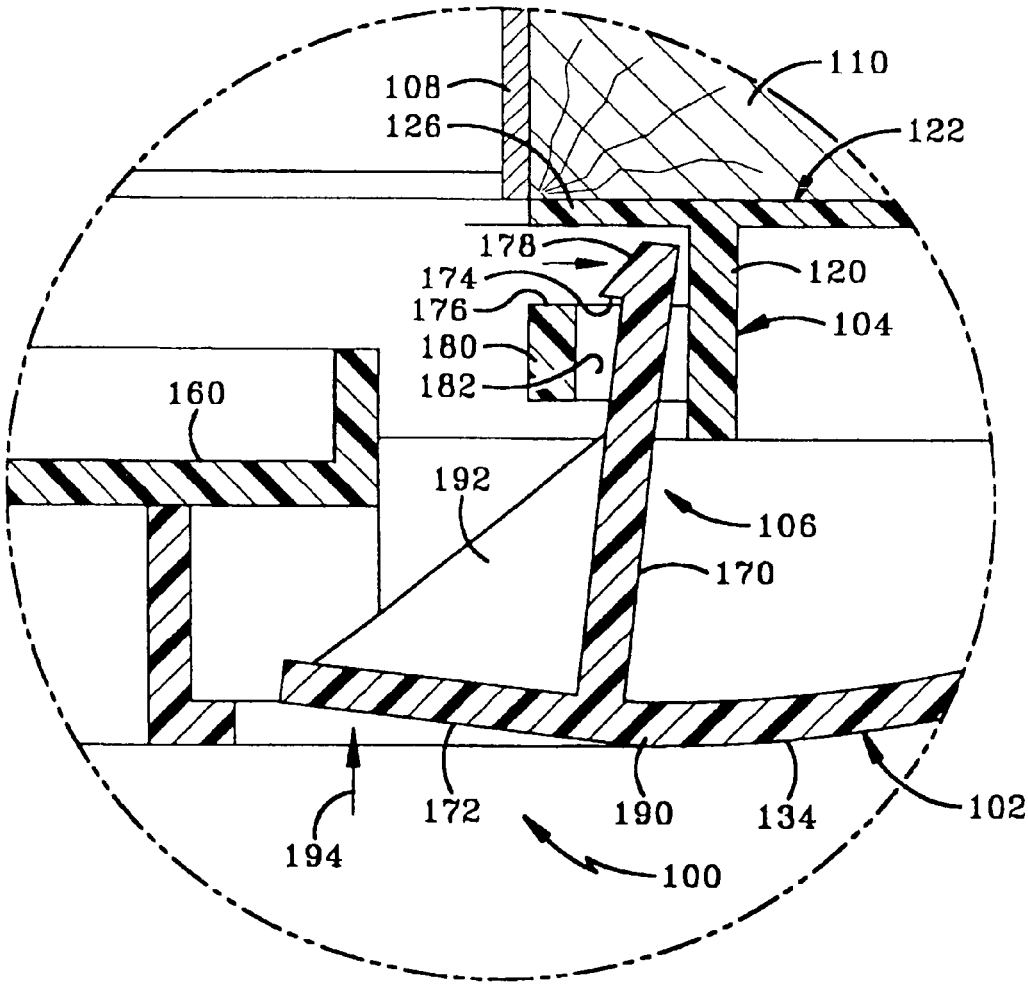
FIG. 8 is a view similar to FIG. 7 showing the lock element in a detached position.
Figure 10:
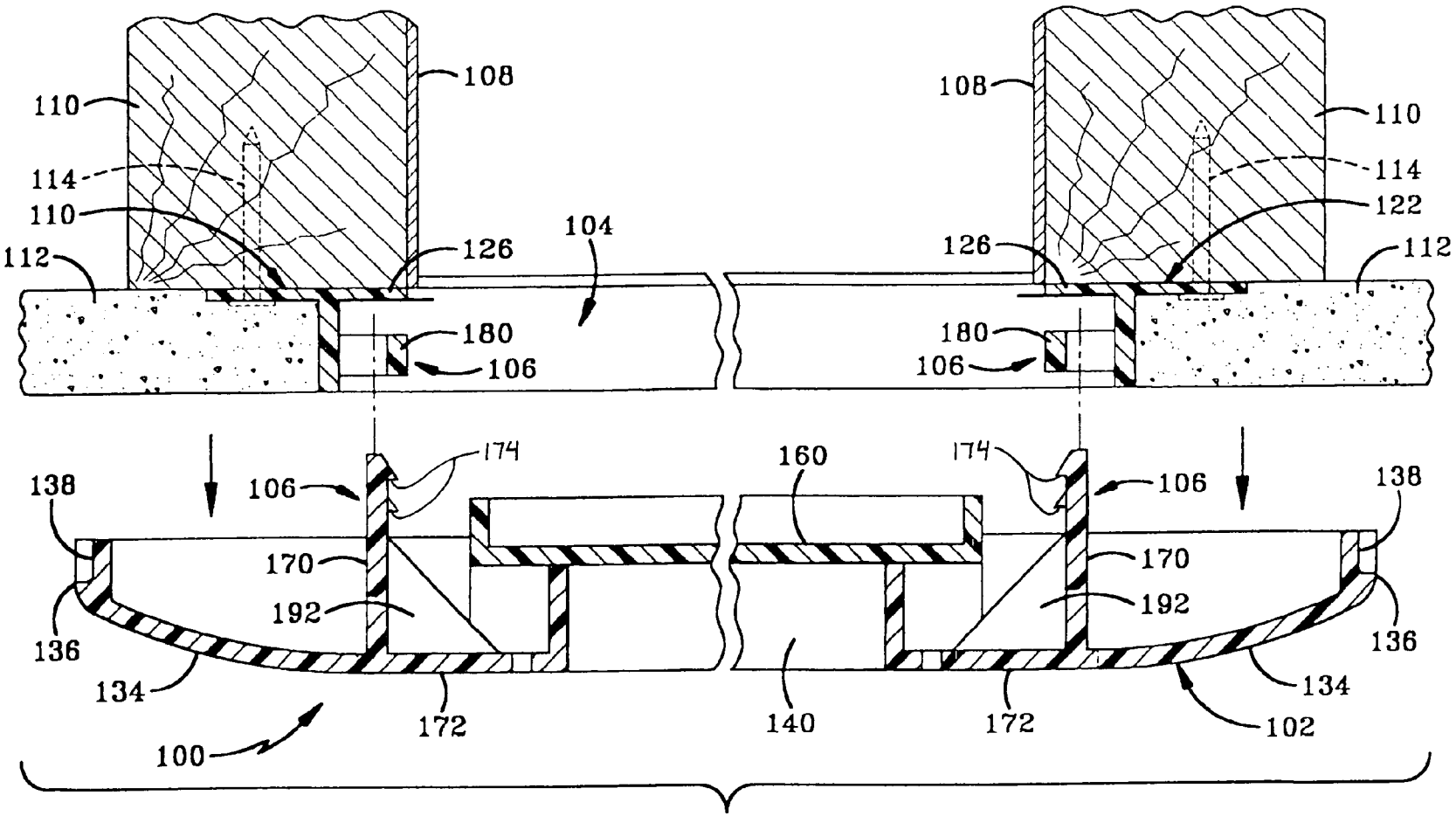
FIG. 10 is a view similar to FIG. 6 showing the grille being removed from the connector frame.

Lock element 106 generally includes at least one element that is cantilevered from either grille 102 or connector frame 104. In the exemplary configuration, a portion of lock element 106 is cantilevered from grille 102. In an alternative configuration, the elements of lock element 106 may be reversed such that lock element 106 projects forwardly from connector frame 104. In such an alternative configuration, the following descriptions apply. Lock element 106 may be pivoted between a locked position (FIG. 7) and an unlocked position (FIG. 8). In the exemplary configuration where lock element 106 is cantilevered from grille 102, lock element includes a lock finger 170 and a lock foot 172. Lock finger 170 includes a lock surface 174 that engages a portion of connector frame 104 when grille 102 is locked to connector frame 104 with lock element 106 in the locked position. Lock surface 174 may be a flat surface that extends substantially parallel to body 122 of connector frame 104. Connector frame 104 includes a lock surface 176 positioned to engage lock surface 174 in a snap fit connection to hold grille 102 in position. In order to facilitate the connection of grille 102 to connector frame 104, lock finger 170 includes an angled surface 178 that forces lock finger 170 to flex and create a resilient force immediately before lock surfaces 174 and 176 engage each other to lock grille 102 to connector frame 104. Lock finger 170 may face inwardly toward opening 124 or outwardly toward side wall 136. In the exemplary configuration, finger 170 faces inwardly. Connector frame 104 thus includes a bridge 180 that defines an opening 182 to receive lock finger 170. Bridge 180 also includes a rear surface that defines lock surface 176. Bridges 180 extend inwardly from opposed side portions of flange 120 as shown in FIG. 6. FIG. 10 depicts an alternate configuration wherein each lock finger 170 carries a pair of spaced lock surfaces 174 that allow combination 100 to work with wall coverings 112 of different thicknesses. In this alternate configuration, the outermost lock surface 174 in FIG. 10 is sized to work with the thickest wall covering 112. A plurality of lock surfaces 174 may be used to create a ratchet effect when grille 102 is connected to frame 104 so that a tight fit is achieved to prevent air leakage.

Figure 9:
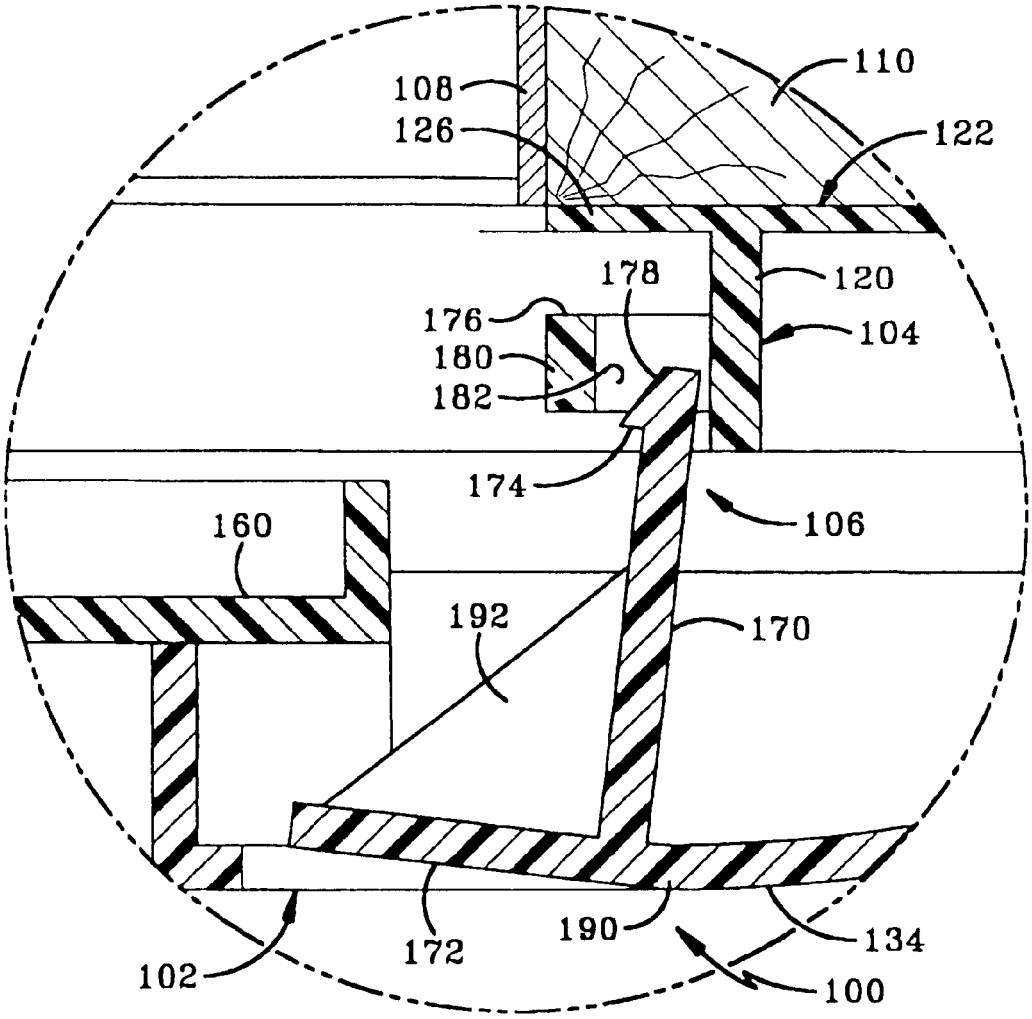
FIG. 9 is a view similar to FIG. 7 showing the grille being removed from the connector frame.

Lock element 106 is connected to front wall 132 of grille 102 at a joint 190 where lock element 106 may pivot with respect to grille 102. Front wall 132 may be thickened or thinned at joint 190 to vary the resilient strength of lock element 106. Each lock element 106 may thus be manipulated from the front of grille 102 as shown in FIG. 8. A rib 192 extends between lock foot 172 and lock finger 170 to ensure that force 194 acting against lock foot 172 is efficiently transferred to lock finger 170. In operation, the user places a fingertip in each notch 138 and a thumb on the outer surface of lock foot 172 and pushes inwardly with the thumbs. While pushing inwardly on lock feet 172, the user pulls outwardly on grille 102 with his fingertips to remove grille 102 from connector frame 104 as shown in FIG. 9.

Figure 18:
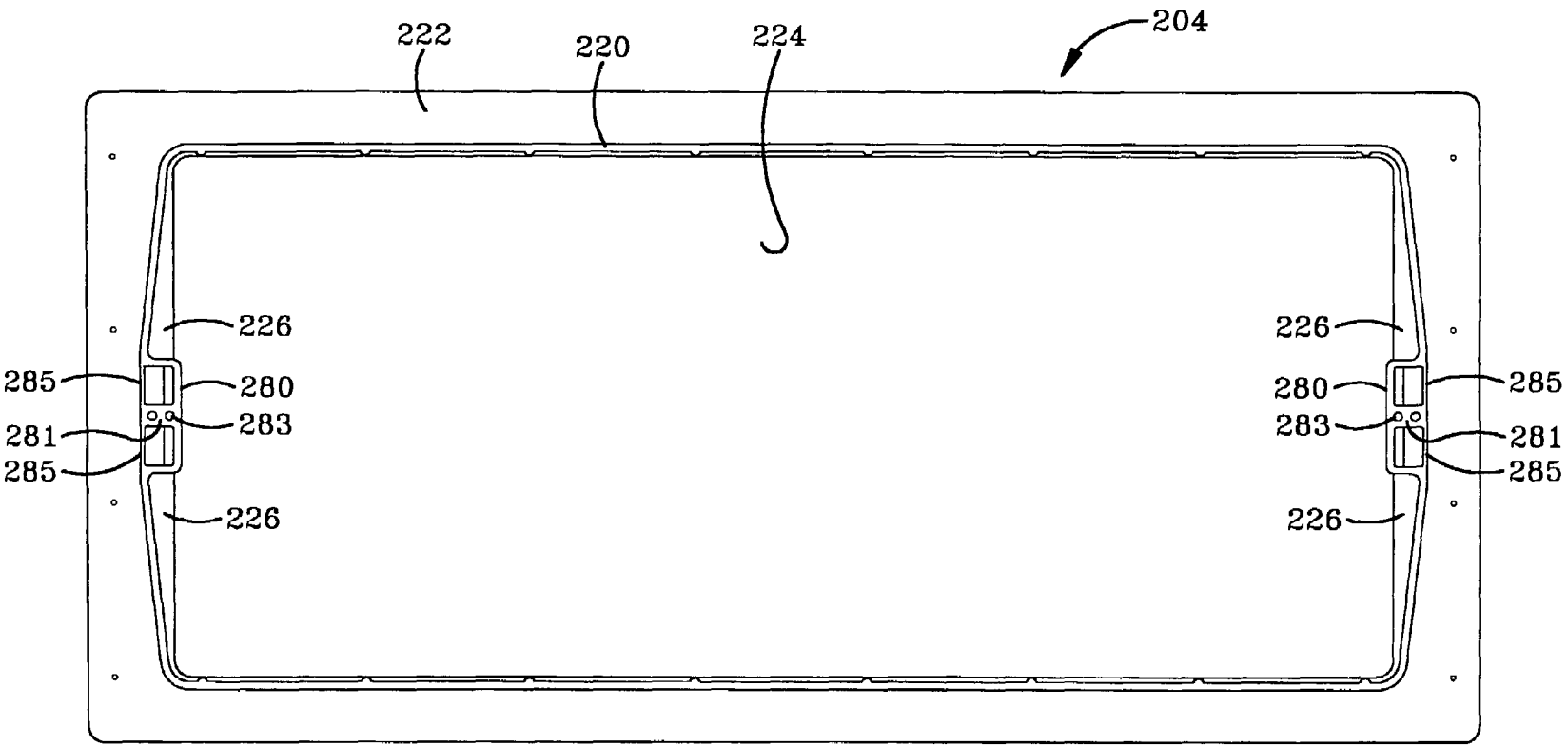
FIG. 18 is a front elevation view of an alternative configuration of the connector frame.
Figure 20:
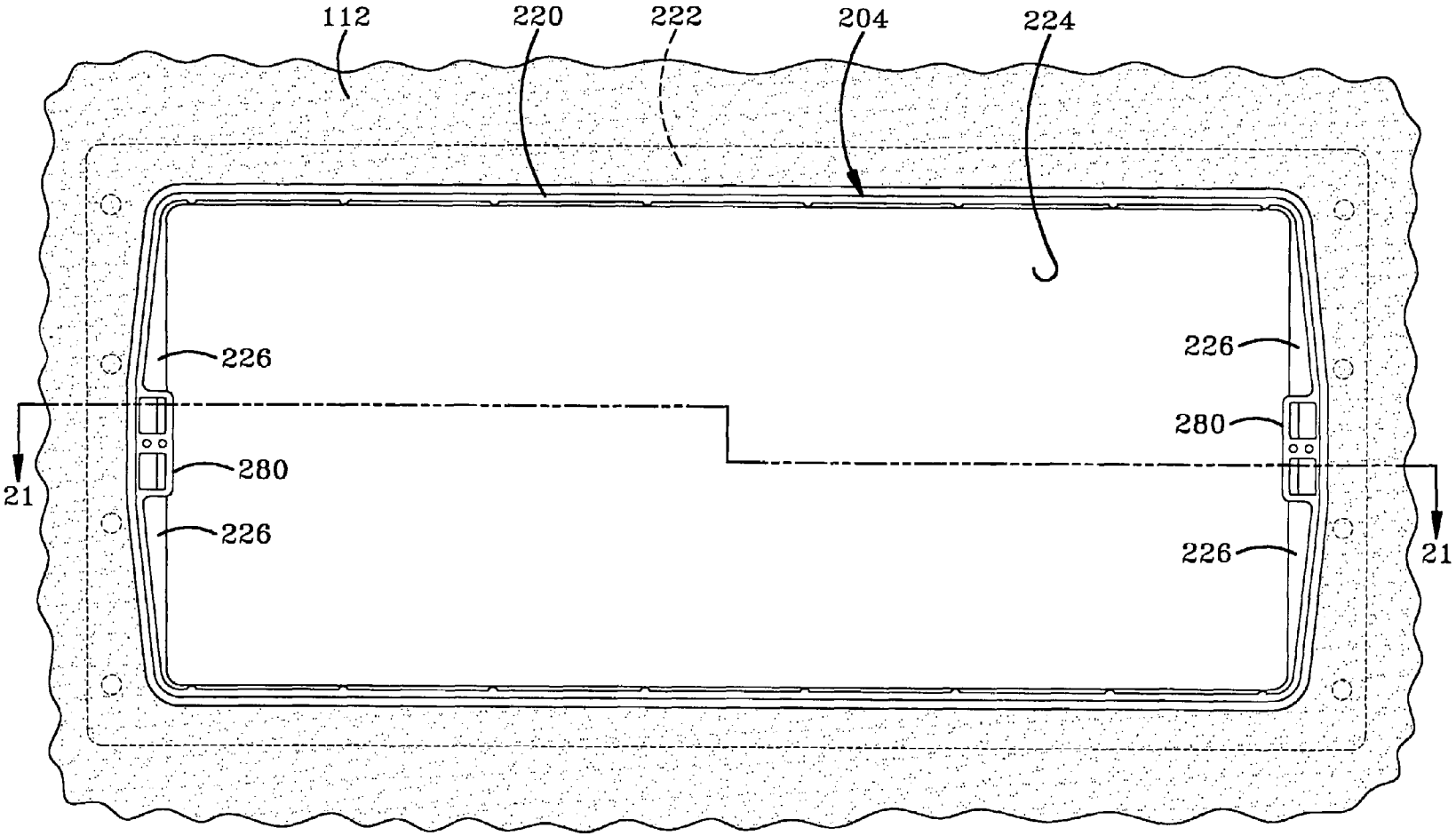
FIG. 20 is a front elevation view of the FIG. 18 connector frame configuration installed in a wall.
Figure 21:
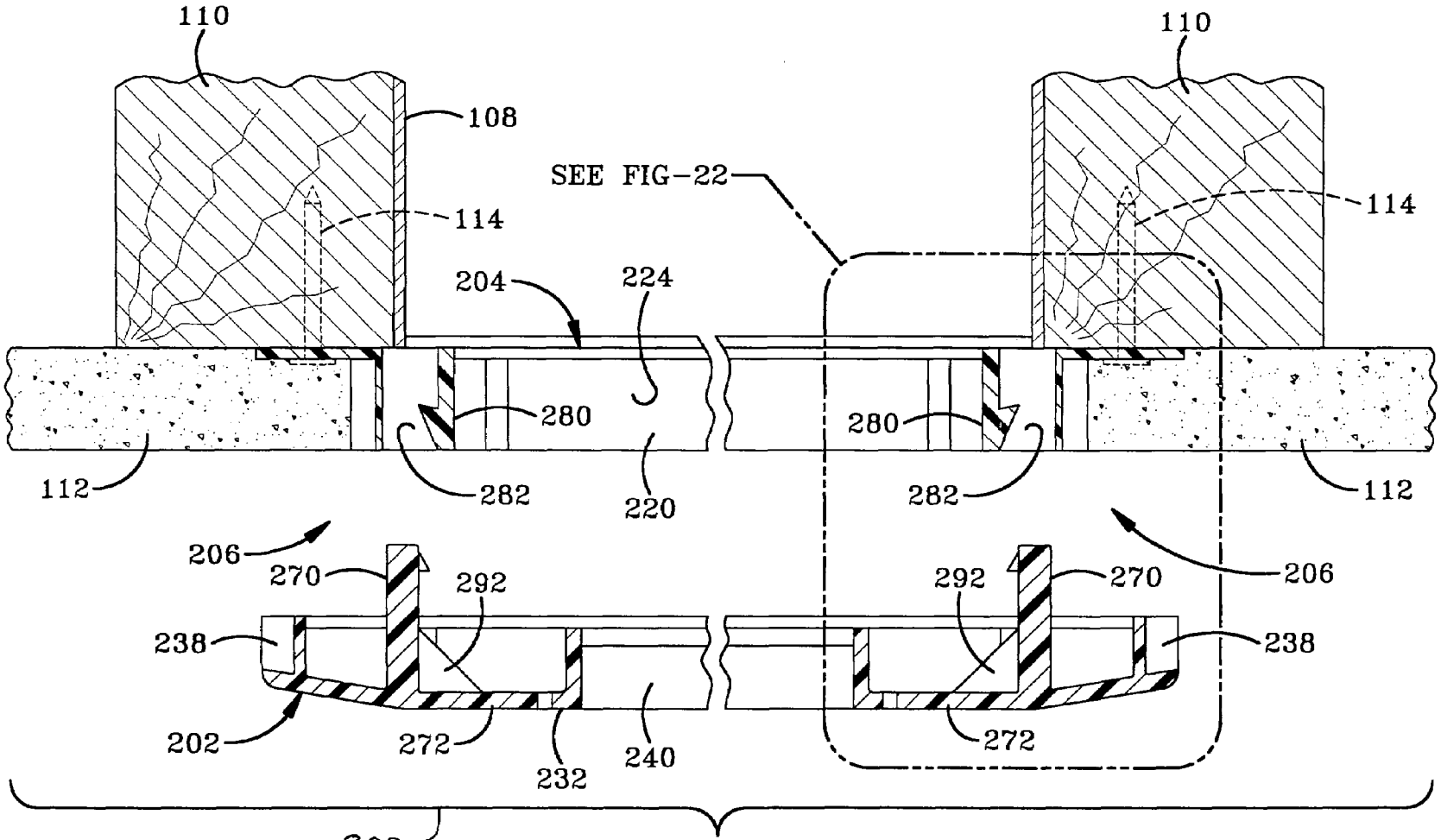
FIG. 21 is a section view taken along line 21-21 of FIG. 20 with the grille of FIG. 13 aligned with the openings of the connector frame.
Figure 22:
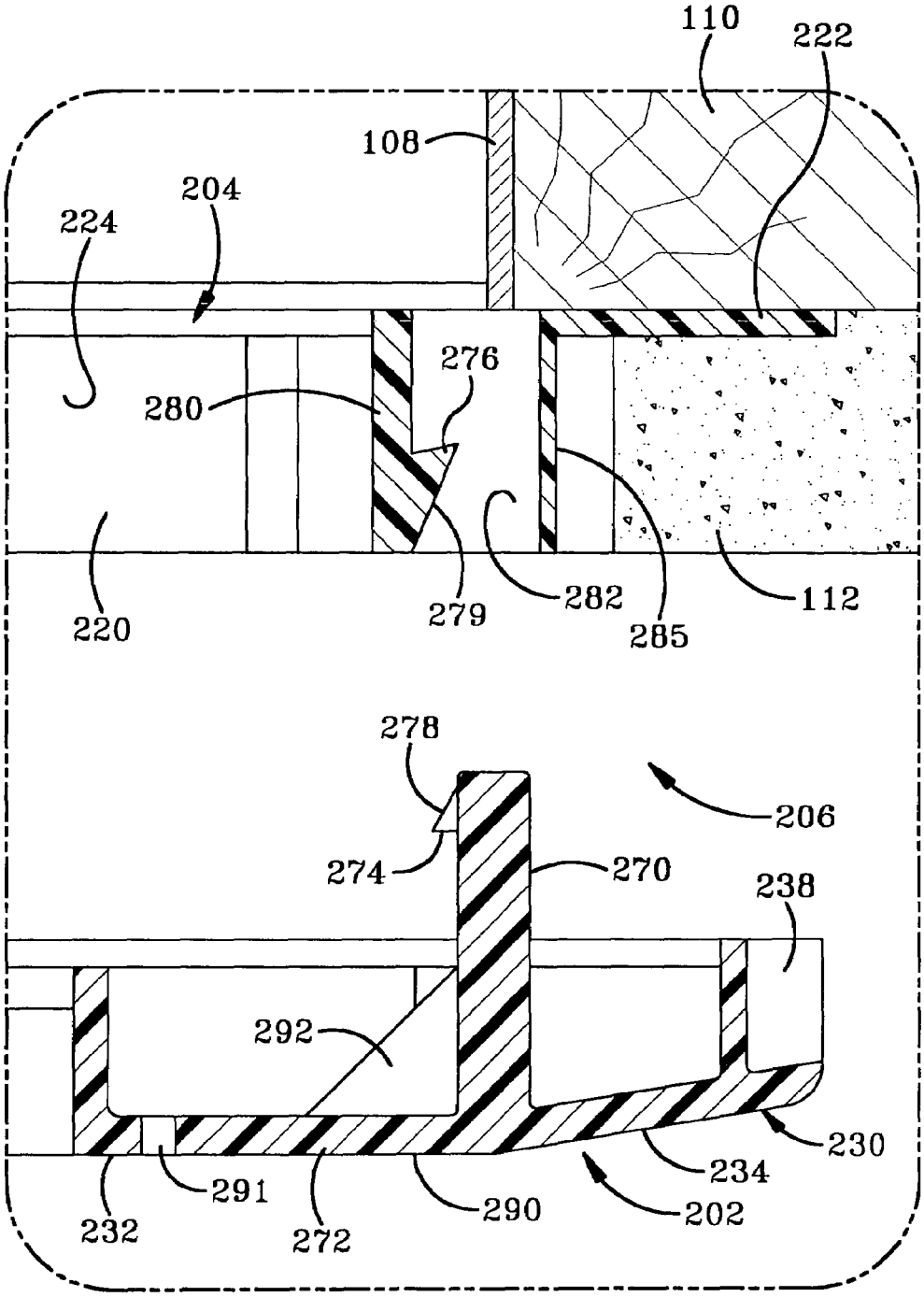
FIG. 22 is an enlarged view of the encircled portion of FIG. 21.

An alternative configuration of the combination of the invention is indicated generally by the numeral 200 in FIGS. 13-33. Combination 200 generally includes a grille 202 and a connector frame 204 that are releasably connected together with at least one lock element 206. Connector frame 204 may be provided in a variety of shapes as described above with the exemplary configuration being a rectangle. Connector frame 204 includes at least a first flange 220 that projects outwardly from a body 222. Flange 220 and body 222 are perpendicular with respect to each other in the exemplary configuration of the invention. In other configurations, flange 220 and body 222 may be provided at other angles. Body 222 is designed to fit behind wall covering 112 as depicted in FIGS. 20 and 21. Body 222 and flange 220 define an opening 224 that defines the outlet for duct 108 as shown in FIG. 21. Flange 220 may be continuous as shown in the drawings or may include a plurality of spaced sections that are disposed about opening 224. Flange 220 extends from body 222 a distance substantially equal to the thickness of a typical thin wall covering 112 with thicker wall coverings extending past the edge of flange 220. As shown in FIG. 18, portions of body 222 extend inwardly from flange 220 to form inner ledges 226 along the sides of connector frame 204. Inner ledges 226 may be defined by forming flange 220 with outwardly angled sidewalls as shown in FIG. 18. Body 222 also defines outer ledges that are disposed between wall covering 112 and studs 110. Connector frame 204 may be integrally fabricated from a single mold and may be fabricated from a moldable plastic.

Grille 202 generally includes a body 230 having a front wall 232, a sidewall 236, and a perimeter edge wall 234 that extends about the perimeter of front wall 232 to provide a smooth transition between front wall 232 and sidewall 236. Sidewall 236 defines a pair of opposed finger access notches 238 (FIG. 14) that allow the user to obtain a secure grip on grille 202 when the user is removing grille 202 from connector frame 204. Notches 238 are formed by bending sidewall 236 inwardly without altering the thickness of sidewall 236. Front wall 232 defines a plurality of louvers 240 that may be formed in a variety of configurations and provided in a variety of patterns. Louvers 240 may be adjustable or fixed. The louver pattern 240 may provide an opening for a handle 162 used with a vent 160.

Figure 16:
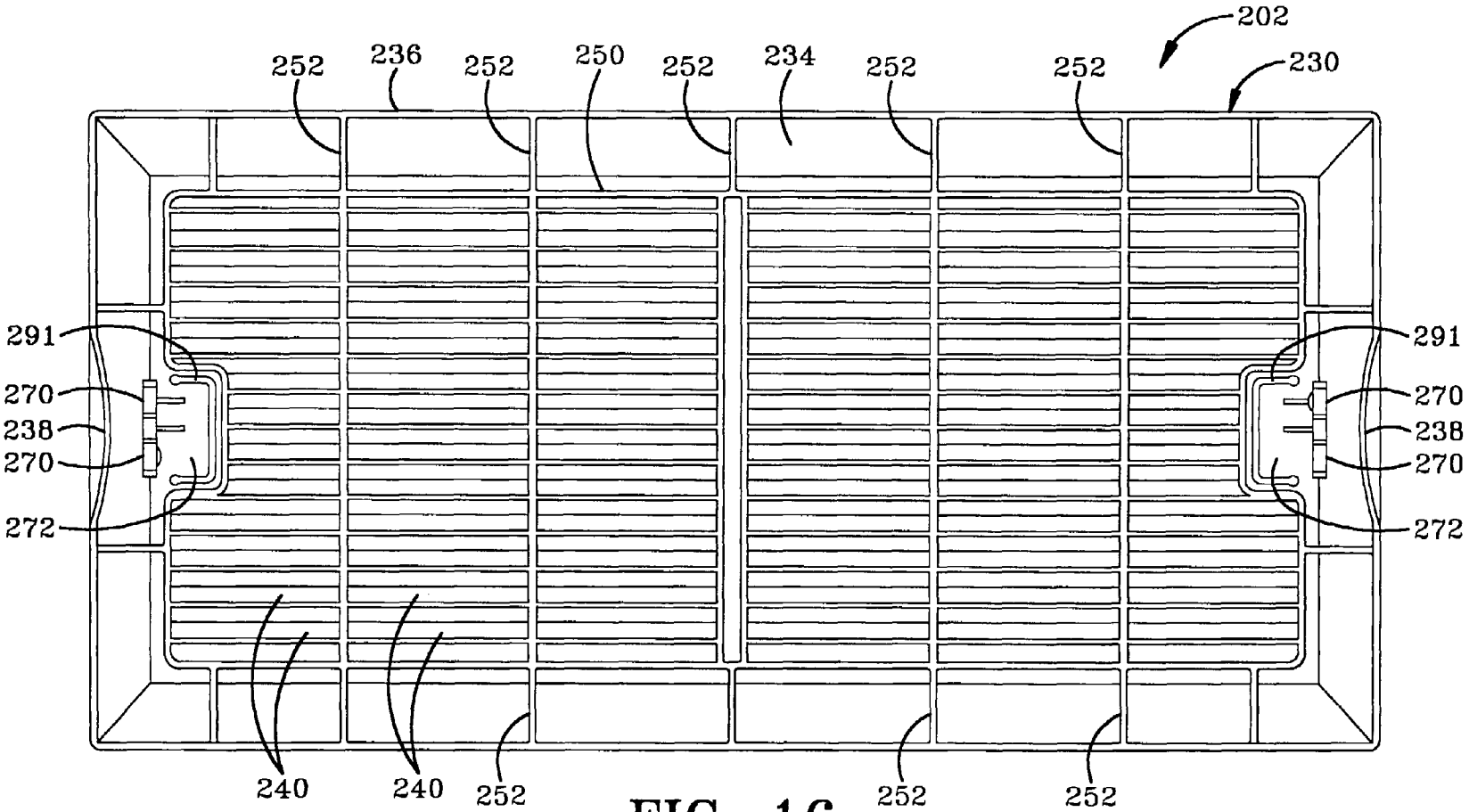
FIG. 16 is a rear elevation view of the grille of FIG. 13.

An inner perimeter wall 250 extends rearwardly from the rear surface of front wall 232 as shown in FIG. 16. Inner perimeter wall 250 extends around the common perimeter of the plurality of openings defined by front wall 232. A plurality of support ribs 252 are used to stiffen grille 202 by extending between sidewall 236 and inner perimeter wall 250.

Lock element 206 generally includes at least one element that is cantilevered from either grille 202 or connector frame 204. In the exemplary configuration, a portion of lock element 206 is cantilevered from grille 202. In an alternative configuration, the components of lock element 206 may be reversed such that lock element 206 projects forwardly from connector frame 204. In such an alternative configuration, the pivoting motion to unlock the lock element is different because the lock fingers projecting from the connector frame are fixed with portions of grille 202 flexing to release the lock.

Figure 29:
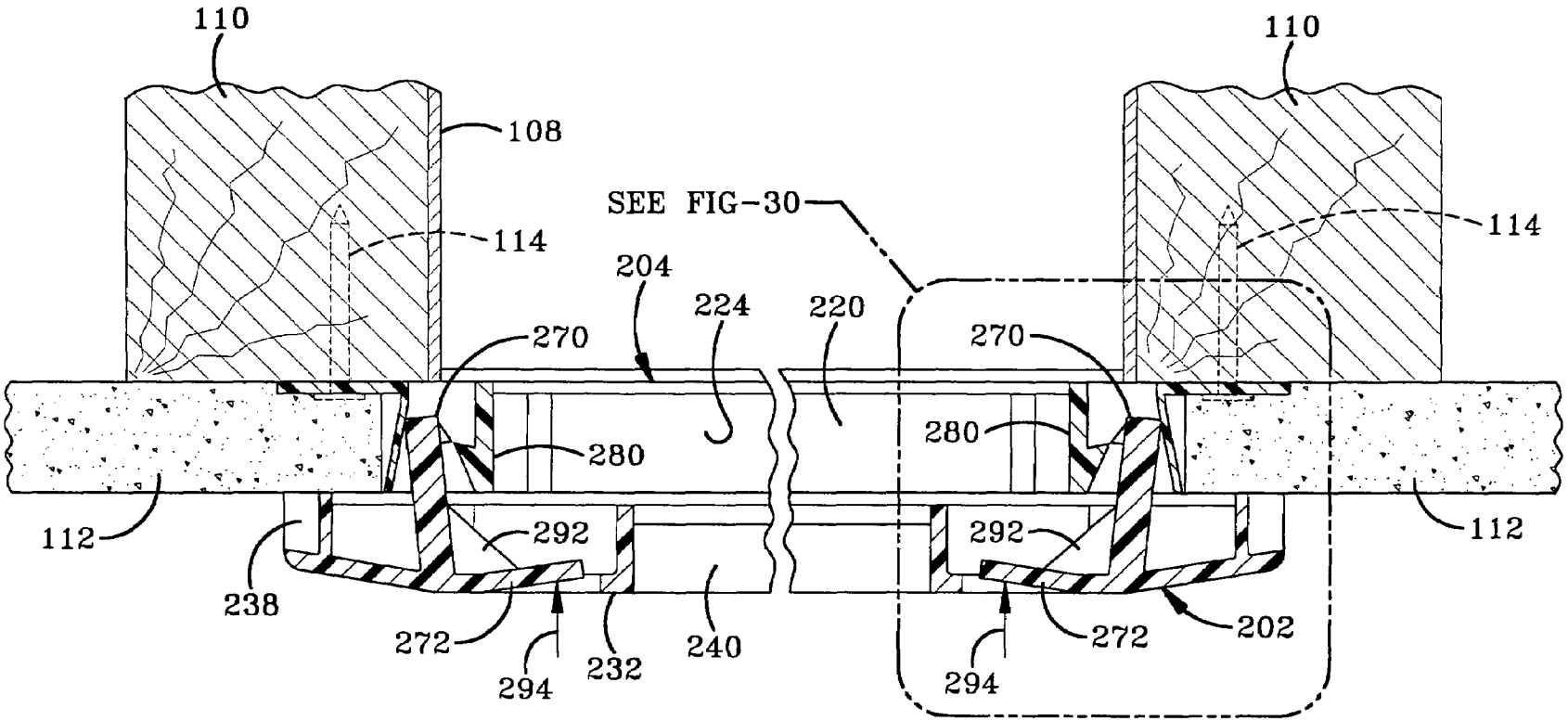
FIG. 29 is a view similar to FIG. 25 showing the lock elements of the grille being moved to the unlocked position and displacing a portion of the connector frame.

Lock element 206 may be moved between a locked position (FIG. 25) and an unlocked position (FIG. 29). In the exemplary configuration where lock element 206 is cantilevered from grille 202, lock element 206 includes a lock finger 270 and a lock foot 272. Lock finger 270 includes a lock surface 274 that engages a portion of connector frame 204 when grille 202 is locked to connector frame 204 with lock element 206 in the locked position. Lock surface 274 may be a flat surface that extends substantially parallel to body 222 of connector frame 204 when lock element 206 is in the locked position. Multiple spaced lock surfaces 274 may be provided. Connector frame 204 includes a lock surface 276 positioned to lockingly engage lock surface 274 in a snap fit connection to hold grille 202 in position. In order to facilitate the connection of grille 202 to connector frame 204, lock finger 270 includes an angled surface 278 that forces lock finger 270 to flex and create a resilient force before lock surfaces 274 and 276 engage each other to lock grille 202 to connector frame 204. Connector frame 204 may include its own angled surface 279 that cooperates with lock finger 270 to force it to the unlocked position when grille 202 is being connected to connector frame 204. Lock finger 270 may face inwardly towards opening 224 or outwardly towards sidewall 236. In the exemplary configuration, finger 270 faces inwardly.

Connector frame 204 includes a bridge 280 that defines an opening 282 that receives lock finger 270. Bridge 280 also includes a rear surface that defines lock surface 276 and angled wall 279. Connector frame defines a pair of bridges 280 on opposite sides of connector frame 204 as shown in FIG. 18. Bridges 280 may be disposed inwardly or outwardly of flange 220 with the inward position depicted in the drawings.

Figure 14:
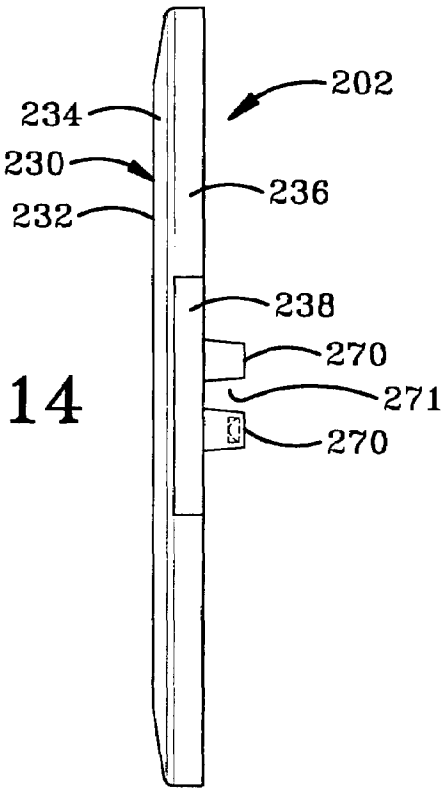
FIG. 14 is a right side elevation view of FIG. 13.
Figure 15:
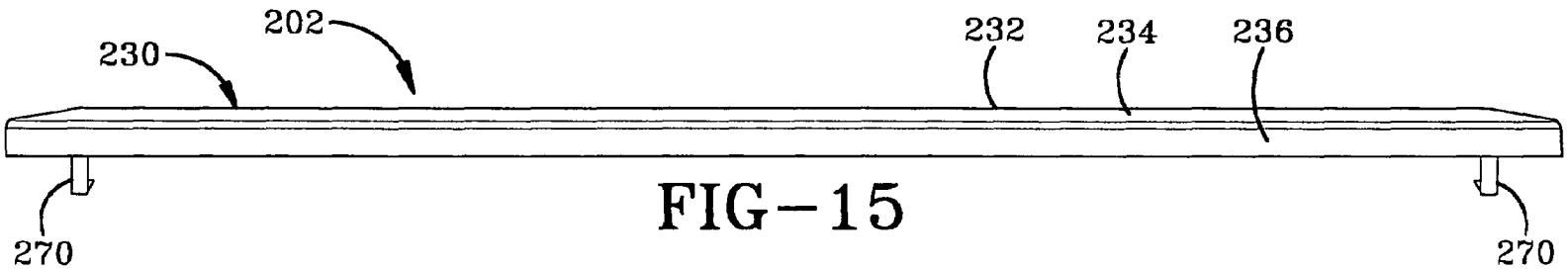
FIG. 15 is a bottom plan view of FIG. 13.
Figure 19:
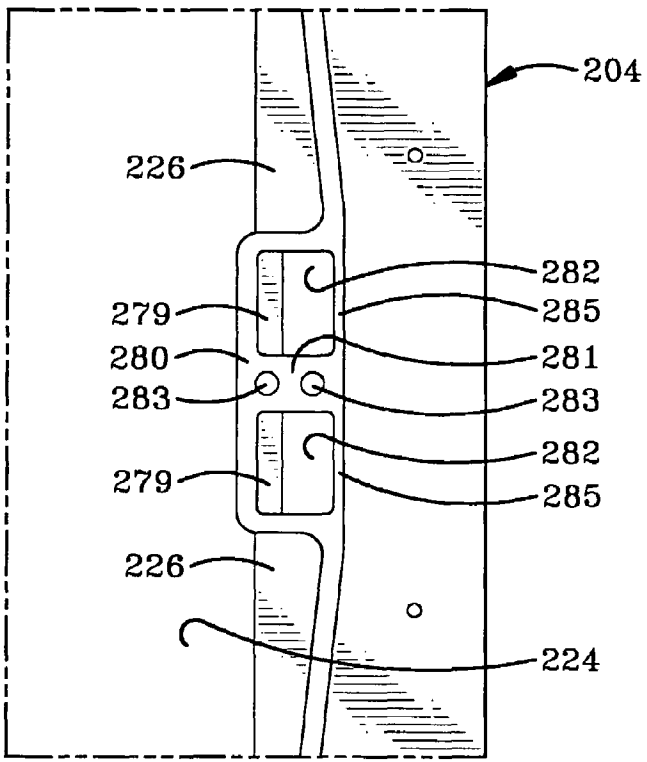
FIG. 19 is an enlarged view of the openings in the connector frame that receive the lock fingers of the grille.
Figure 17:
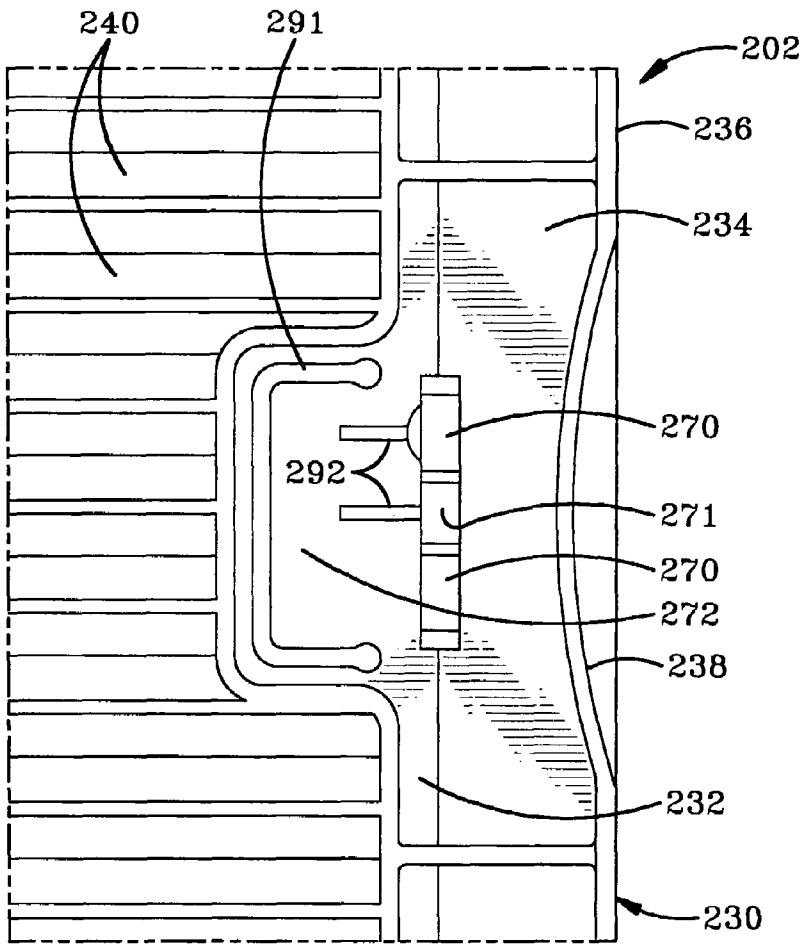
FIG. 17 is an enlarged view of the lock finger.
Figure 27:
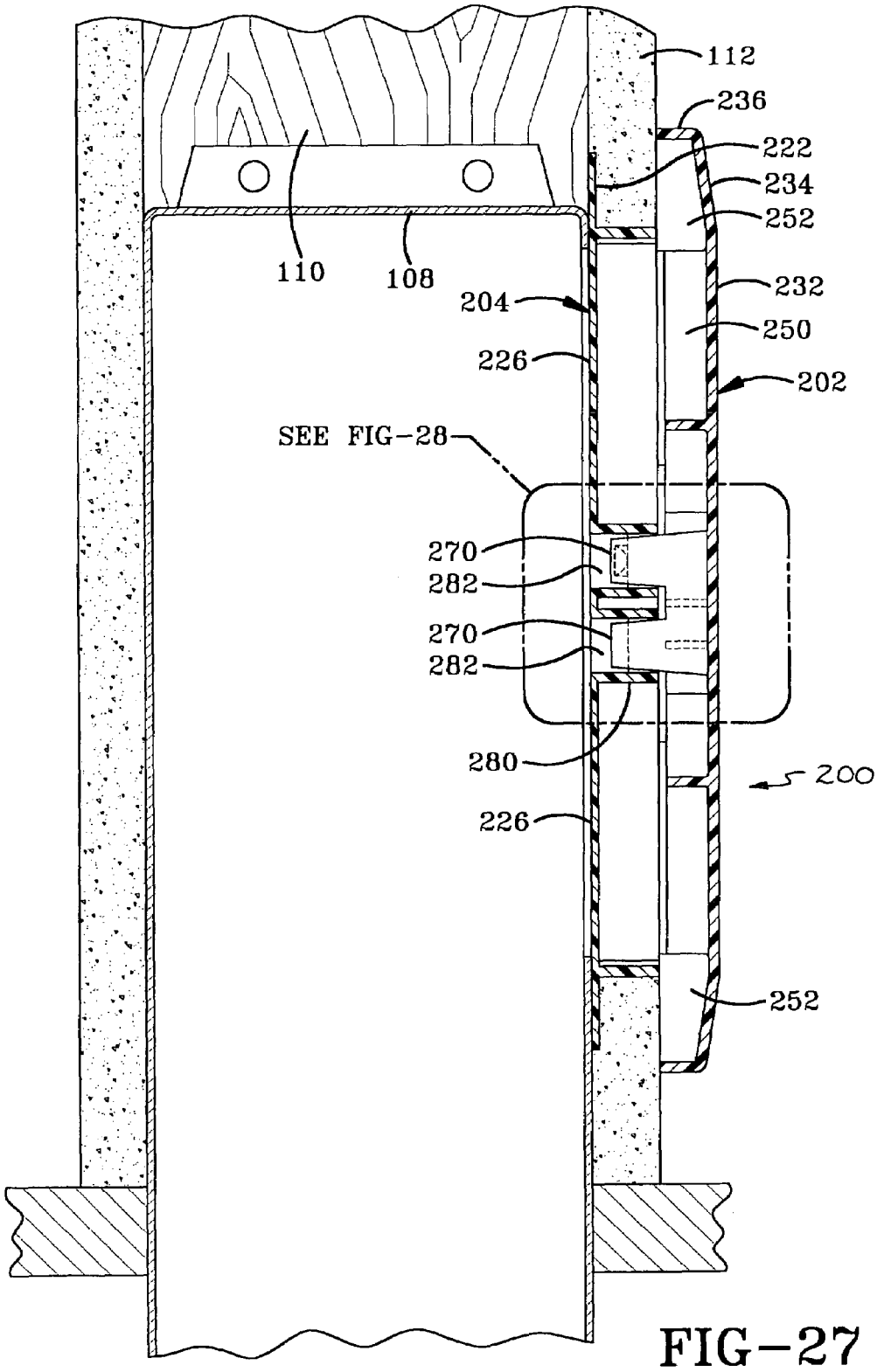
FIG. 27 is a section view taken along line 27-27 of FIG. 24.
Figure 28:
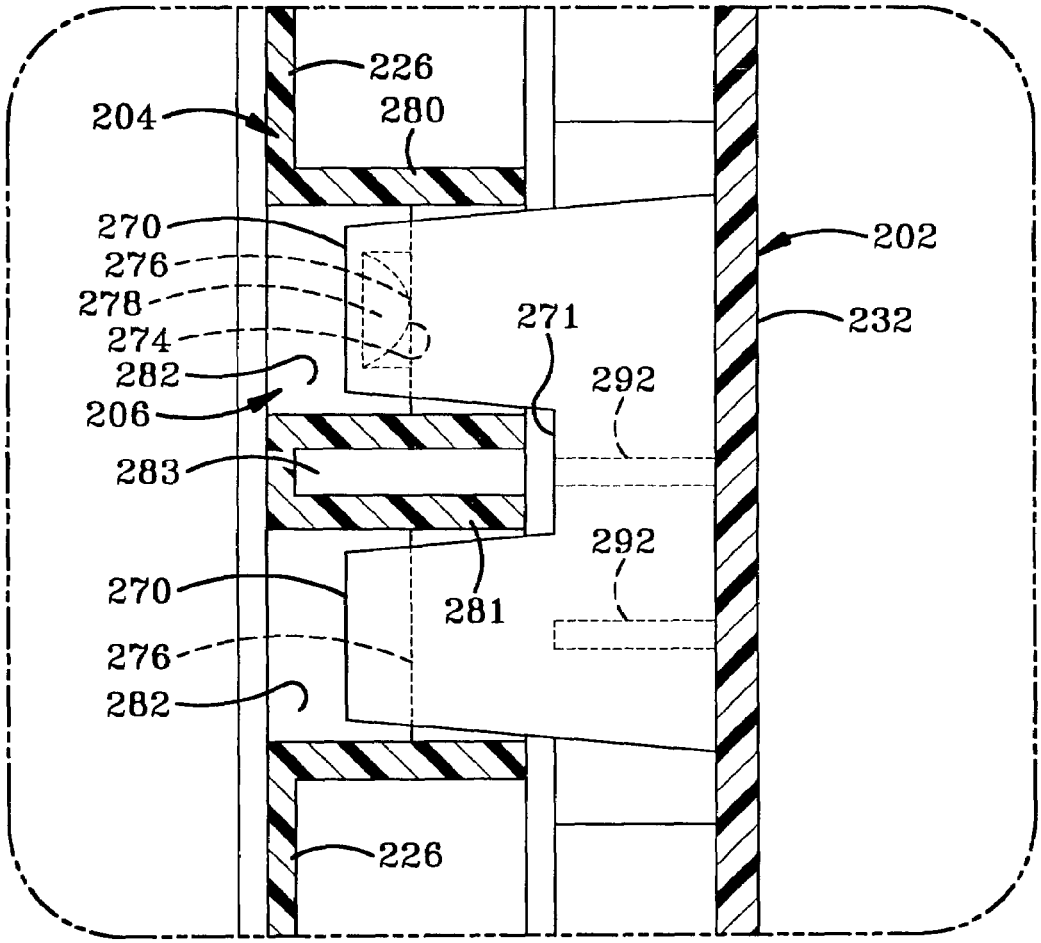
FIG. 28 is an enlarged view of the encircled portion of FIG. 27.
Figure 32:
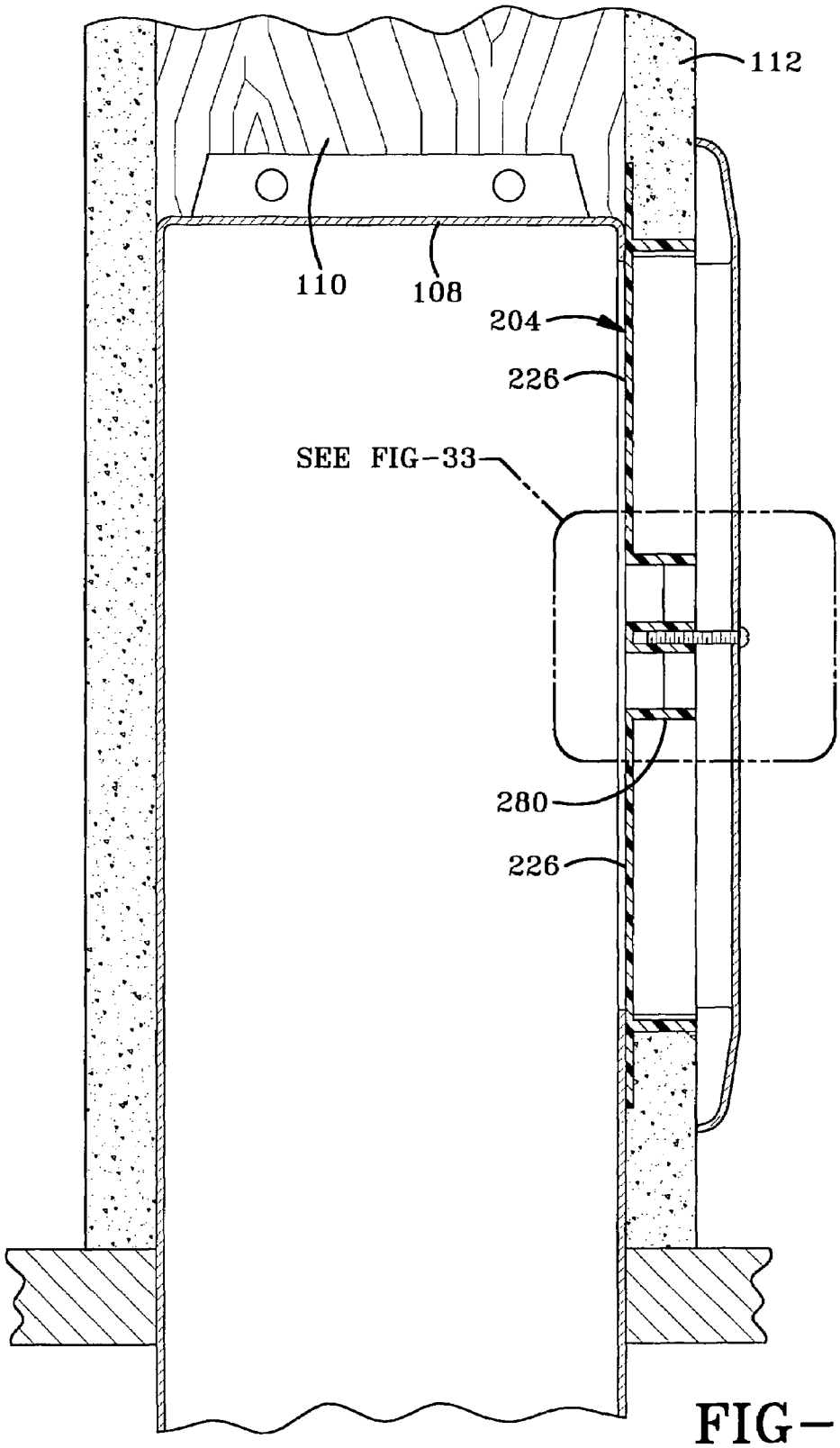
FIG. 32 is a view similar to FIG. 27 showing a grille being connected to the connector frame with a threaded fastener.
Figure 33:
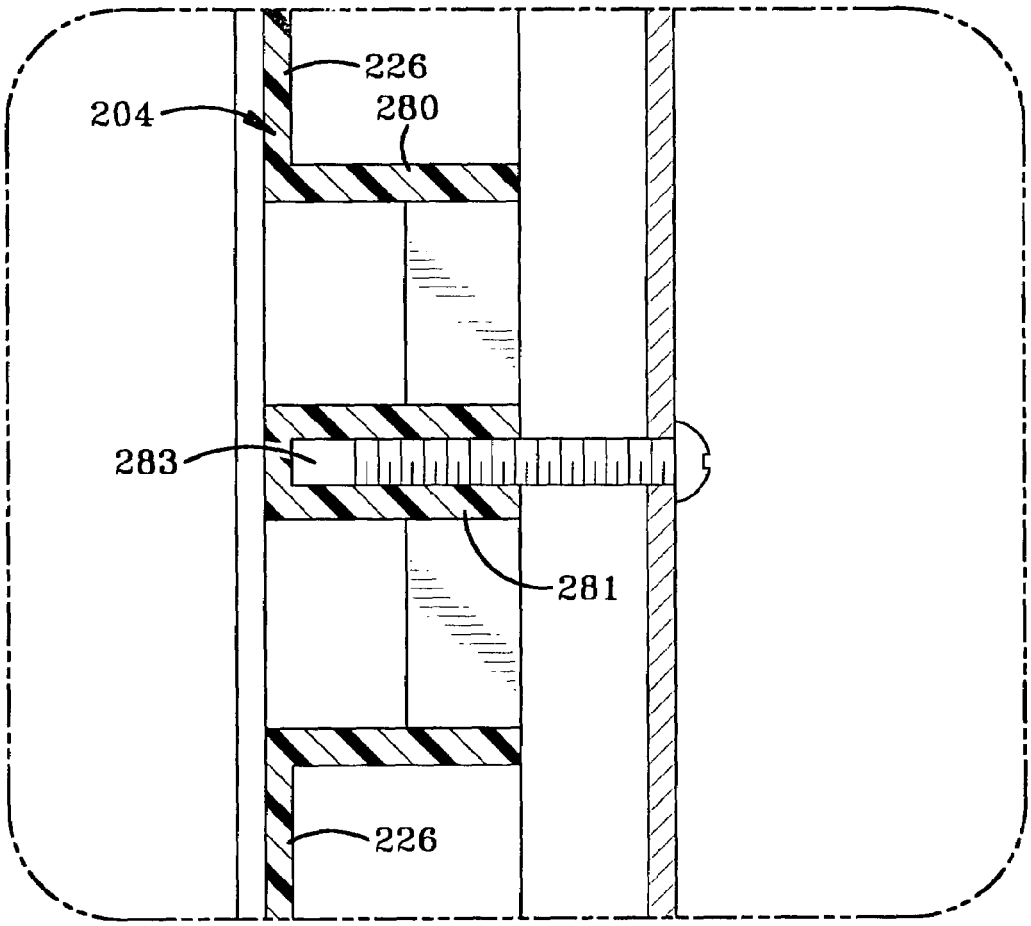
FIG. 33 is an enlarged view of the encircled portion of FIG. 32.

Connector frame 204 may include an optional mounting block 281 positioned in opening 282 such that opening 282 is divided into first and second portions as shown in FIGS. 18 and 19. Each mounting block 281 is positioned to align with the openings in existing grilles so that threaded fasteners may be used to connect existing grilles to connector frame 204 as shown in FIGS. 32 and 33. Each mounting block 281 may define one or two holes 283 adapted to receive threaded fasteners. Openings 283 are spaced for different sized prior art grilles. The prior art grille may have two threaded fasteners in the outer holes, two threaded fasteners in the inner holes, or one in the outer hole and one in the inner hole. When mounting blocks 281 are provided, lock fingers 270 are split into first and second portions as shown in FIG. 14 so that the gap 271 between portions 270 accommodates mounting block 281 as shown in FIGS. 27 and 28. Split fingers 270 may be wedge-shaped to self-align with openings 282. Fingers 270 may be sized to frictionally engage connector frame 204. When split fingers 270 are used, the lock surfaces 274 provided on fingers 270 may be disposed in different locations on the different fingers so that different fingers are used with different thickness wall coverings 112.

Figure 23:
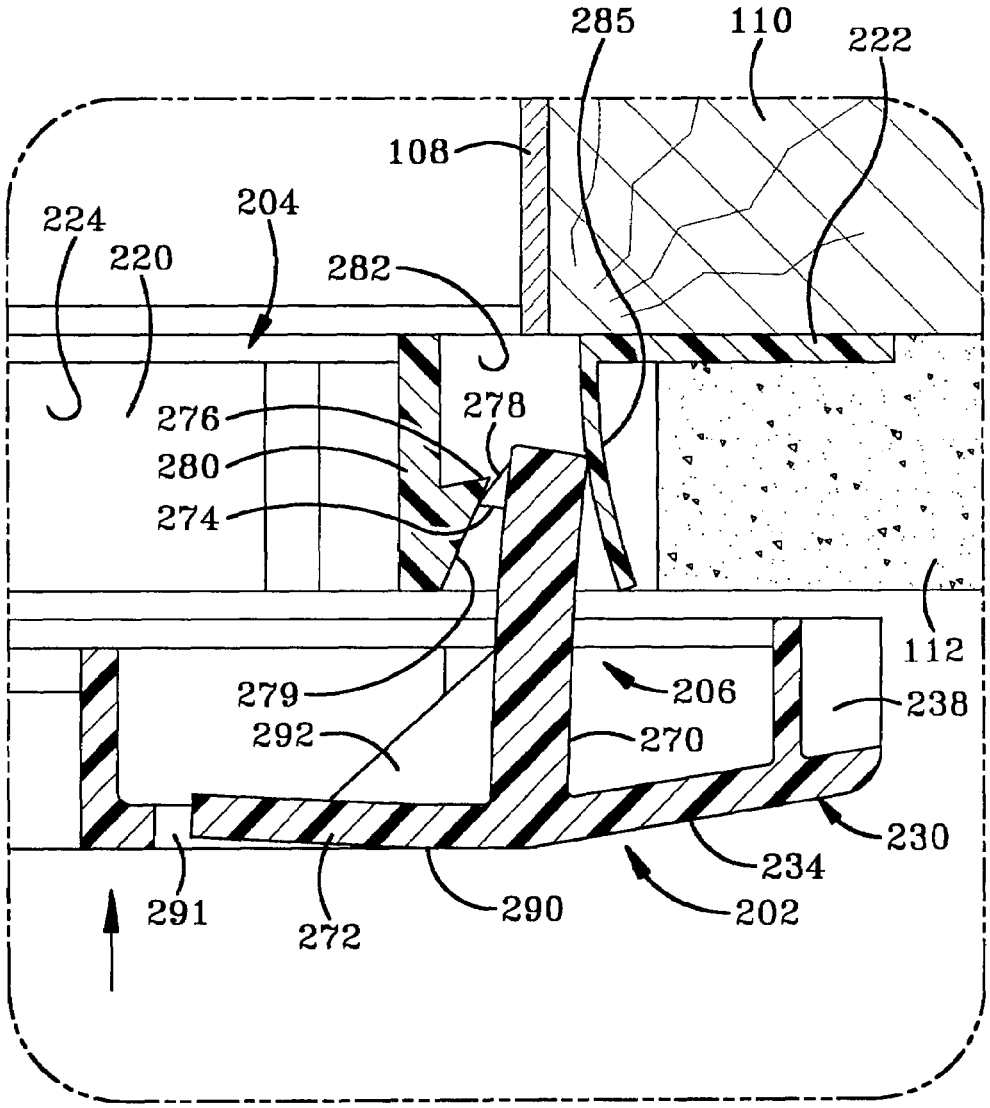
FIG. 23 is a view similar to FIG. 22 showing the grille being installed with the locking finger displacing a portion of the connector frame.
Figure 24:
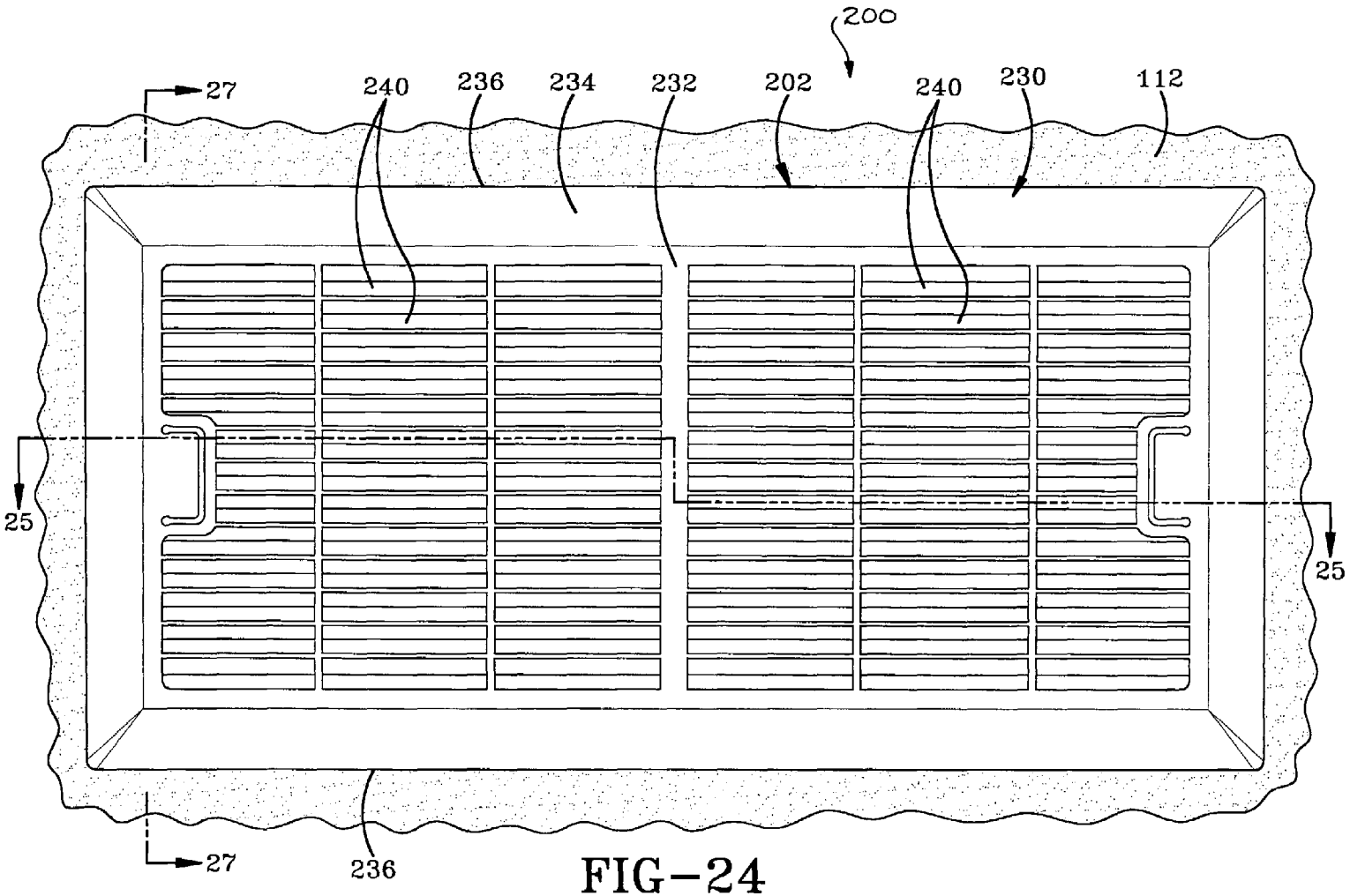
FIG. 24 is a front elevation view of the grille of FIG. 13 connected to the connector frame of FIG. 18.
Figure 25:
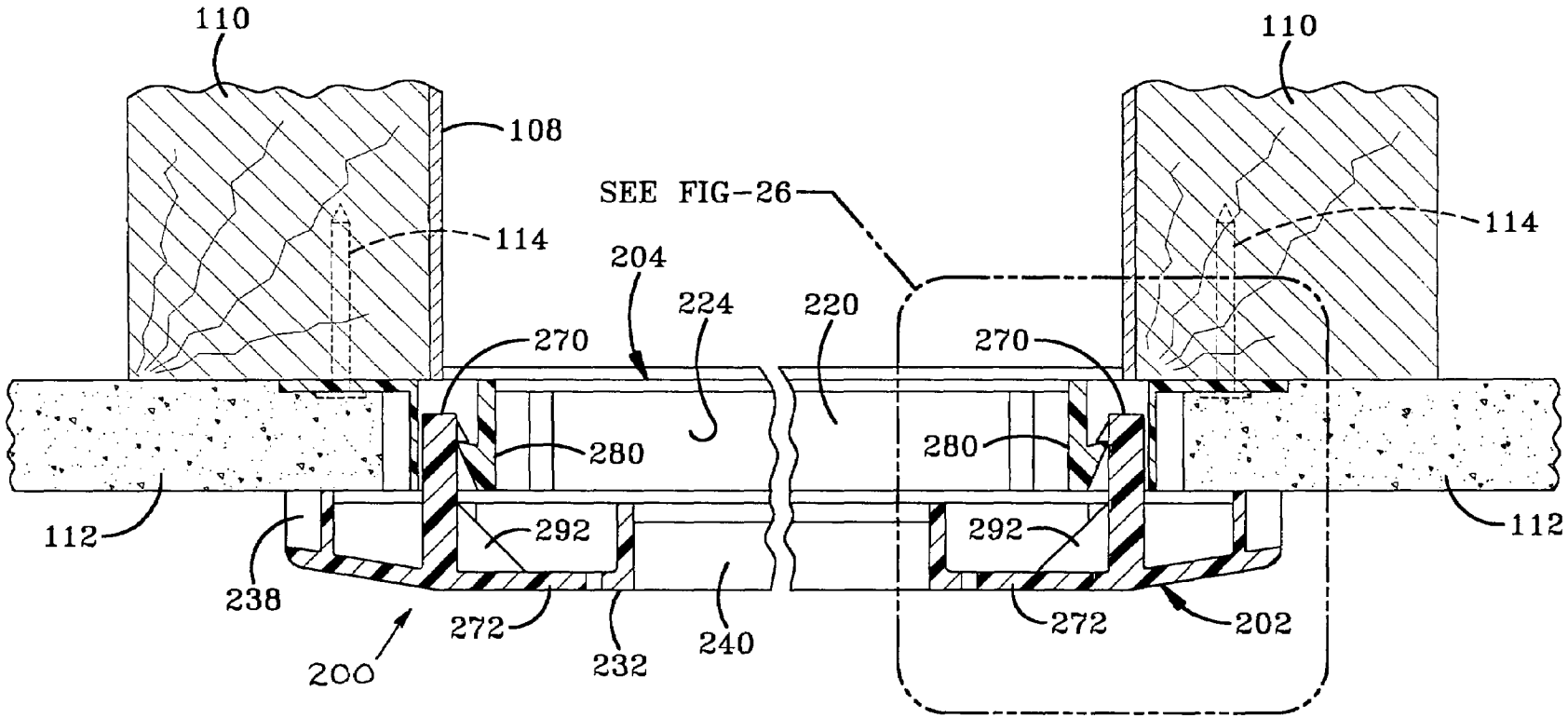
FIG. 25 is a section view taken along lines 25-25 of FIG. 24.
Figure 26:
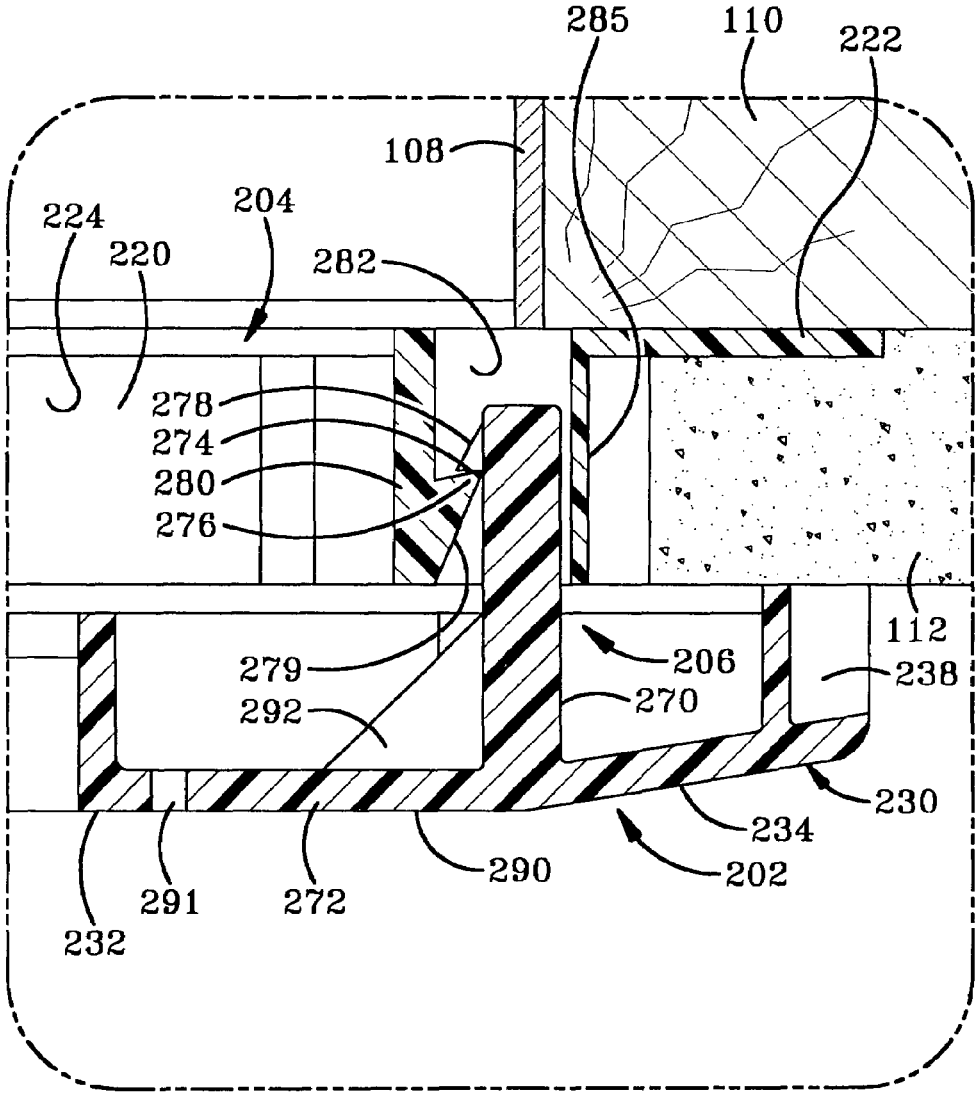
FIG. 26 is an enlarged view of the encircled portion of FIG. 25.

As shown in FIGS. 19, 23, and 29, flange 220 may have optional areas of reduced thickness opposite bridges 280. When these areas of reduced thickness are used, they function as retaining walls 285. Retaining walls 285 are resilient and flex outwardly away from bridges 280 when lock fingers 270 are inserted in openings 282 and moved to the unlocked position. This flexing is shown in FIGS. 23 and 29. Retaining walls 285 thus help hold lock fingers 270 in position by engaging lock fingers 270 when lock fingers 270 are in the locked position in openings 282. Each lock finger 270 is thus engaged by bridge 280 and retaining wall 285 when disposed in opening 282 while grille 202 is locked to connector frame 204. FIGS. 25 and 26 show the position of the outer end of finger 270 with respect to retaining wall 285. The outer end is spaced from body 222 so that it will flex wall 285 when moved to the unlocked position. Retaining walls 285 reduce the chance that grille 202 will vibrate loose or fall off of connector frame 204. Retaining walls 285 have a thickness that is about half of the thickness of bridges 280. In another configuration, each retaining wall 285 is non-continuous and is cantilevered from flange 220 so that it resiliently engages finger 270 when finger 270 is disposed in opening 282.

Figure 30:
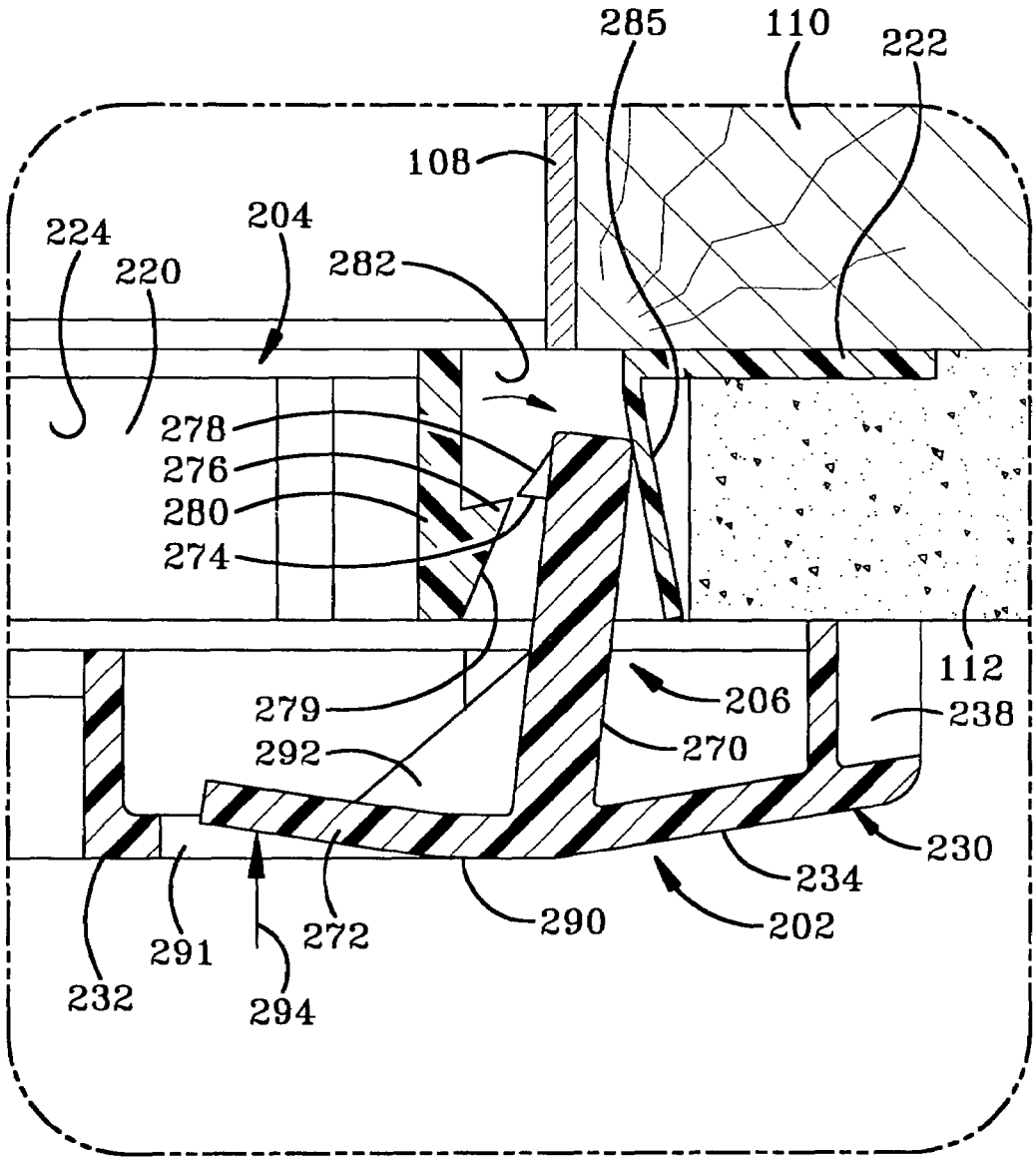
FIG. 30 is an enlarged view of the encircled portion of FIG. 29.
Figure 31:
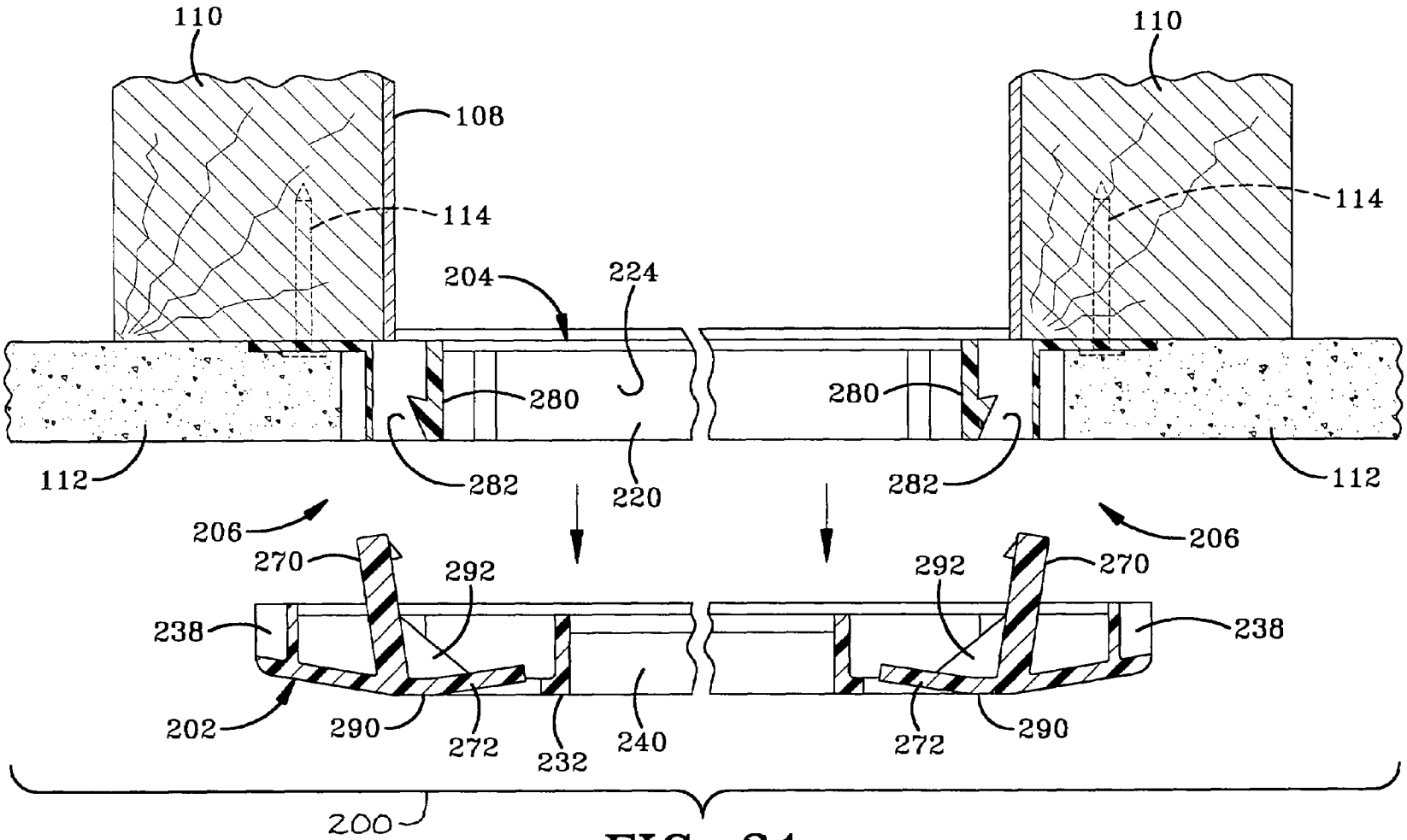
FIG. 31 is a view similar to FIG. 29 showing the grille removed from the connector frame.

Lock element 206 is connected to front wall 232 of grille 202 at a joint 290 where lock element 206 may pivot with respect to grille 202. Front wall 232 may be thickened or thinned at joint 290 to vary the resilient strength of lock element 206. As shown in FIG. 16, fingers 270 may be spaced from the ends of slot 291 that defines foot 272. The spacing allows the resiliency of fingers 270 to be defined. Each lock element 206 may thus be manipulated from the front of grille 202 as shown in FIGS. 29 and 30. A rib 292 extends between lock foot 272 and lock finger 270 to ensure that force 294 acting against lock foot 272 is efficiently transferred to lock finger 270. A plurality of ribs 292 may be used.

In operation, the user may simply push grille 202 against frame 204 in order to mount grille 202 against the wall. In order to remove grille 202, the user places a fingertip in each notch 238 and a thumb on the outer surface of each lock foot 272. The user pushes on each lock foot 272 causing lock finger 270 to move to the unlocked position and flex retaining wall 285. While lock fingers 270 are in the unlocked position, the user pulls outwardly on grille 202 with his fingertips to remove grille 202 from connector frame 204.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. In combination, a grille and a connector frame for mounting the grille at a duct outlet in a wall; the combination having at least one lock element that is cantilevered from one of the connector frame and the grille and releasably engages the other of the connector frame and grille in a snap fit connection to hold the grille to the connector frame; the lock element having a locked position wherein the grille is held to the connector frame and an unlocked position wherein the grille is removable from the connector frame;

the lock element pivoting between the locked and unlocked positions:

the lock element having a lock surface and the connector frame having a lock surface; the lock surface of the lock element engaging the lock surface of the connector frame when the lock element is in the locked position;

the connector frame including a retaining wall moveable between first and second positions; a portion of the lock element being disposed between the retaining wall and the lock surface of the connector frame when the lock element is in the locked position; and the retaining wall being movable to its second position by a portion of the lock element when the lock element is moved from the locked position to the unlocked position.

2. The combination of claim 1, further comprising a vent pivotably carried by the grille between open and closed positions.

3. The combination of claim 2, wherein the vent includes a handle that projects through a portion of the grille.

4. The combination of claim 1, wherein the lock element is cantilevered from the grille.

5. The combination of claim 4, wherein the lock element includes a lock finger and a lock foot; the lock finger defining the lock surface that engages the connector frame when the grille is locked to the connector frame with the lock element in the locked position.

6. The combination of claim 5, wherein the lock finger is connected to the lock foot at a joint; the lock finger and lock foot pivoting together about the joint with respect to the grille between the locked and unlocked positions.

7. The combination of claim 6, wherein the grille has a front wall that defines a plurality of louvers; the lock foot of the lock element is disposed parallel to the front wall of the grille.

8. The combination of claim 6, further comprising a rib disposed between the lock foot and the lock finger.

9. The combination of claim 5, wherein the connector frame defines a lock ledge; the lock finger engaging the lock ledge when the grille is locked to the connector frame.

10. The combination of claim 1, wherein the connector frame includes spaced mounting blocks adapted to be positioned on opposite sides of the duct outlet.

11. The combination of claim 10, wherein each of the mounting blocks is adapted to receive a threaded fastener that mounts a conventional grille to the connector frame.

12. The combination of claim 11, wherein each mounting block defines a pair of spaced openings.

13. A grille for covering a duct outlet in a surface; the grille comprising:

a body having a front wall that defines a plurality of louvers and a plurality of openings that allow air from the duct outlet to flow through the body;

the body having a front and rear; the rear adapted to face the surface where the grille is disposed;

a lock element connected to the body; the lock element movable between locked and unlocked positions; the locked position of the lock element adapted to hold the grille in position over the outlet;

the lock element including a lock finger and a lock foot connected together at a joint; the joint pivotably connecting the lock element to the body;

the lock finger projecting away from the body of the grille toward the duct outlet;

the lock foot of the lock element being disposed parallel to the front wall of the grille when the lock element is in the unlocked position:

the lock foot and lock finger pivoting together about the joint between the locked and unlocked positions; the unlocked position allowing the grille to be removed from the surface; and the lock foot being accessible from the front of the body such that a user may move the lock foot to cause the lock finger to move to its unlocked position.

14. The grille of claim 13, wherein the body defines a finger access notch aligned with the lock element; the finger access notch adapted to allow a user to pull on the body when unlocking the lock element.

* * * * *